US008109515B2

(12) United States Patent
Fedoseyev et al.

(10) Patent No.: US 8,109,515 B2
(45) Date of Patent: Feb. 7, 2012

(54) THREE-DIMENSIONAL PUZZLE

(75) Inventors: Lev A. Fedoseyev, El Cajon, CA (US); Shlomo Caspi, San Diego, CA (US)

(73) Assignee: Lionsphere Puzzles Partnership, San Diego, CA (US)

( * ) Notice: Subject to any disclaimer, the term of this patent is extended or adjusted under 35 U.S.C. 154(b) by 182 days.

(21) Appl. No.: 11/974,315

(22) Filed: Oct. 12, 2007

(65) Prior Publication Data

US 2009/0096161 A1 Apr. 16, 2009

(51) Int. Cl.
*A63F 9/06* (2006.01)

(52) U.S. Cl. ..... 273/153 S; 273/153 R; 273/156; 273/157 R

(58) Field of Classification Search ..... 273/153 S, 273/153 R, 153 P, 153 J, 154, 155, 156, 157 R, 273/157 A, 158, 159, 160
See application file for complete search history.

(56) References Cited

U.S. PATENT DOCUMENTS

| | | | | |
|---|---|---|---|---|
| 3,081,089 | A | 3/1963 | Gustafson | |
| 4,344,623 | A | 8/1982 | Toshiyuki | |
| 4,378,116 | A | 3/1983 | Rubik | |
| 4,405,131 | A | 9/1983 | Horvath | |
| 4,441,715 | A | 4/1984 | Titus | |
| 4,452,454 | A | 6/1984 | Greene | |
| 4,484,744 | A * | 11/1984 | Gmunder | 273/153 S |
| 4,522,401 | A | 6/1985 | Gustafson | |
| 4,540,177 | A | 9/1985 | Horvath | |
| 4,557,484 | A | 12/1985 | Sherman | |
| 4,856,786 | A | 8/1989 | Gyovai | |
| 4,865,323 | A | 9/1989 | Heusinkveld | |
| 4,889,340 | A | 12/1989 | Greene | |
| 5,074,562 | A | 12/1991 | Green | |
| 5,308,066 | A | 5/1994 | Pataki et al. | |
| 5,358,247 | A | 10/1994 | Meffert | |
| 5,452,895 | A | 9/1995 | Ray | |
| 5,566,941 | A | 10/1996 | Destics | |
| 5,664,779 | A * | 9/1997 | Soovajian, Jr. | 273/153 R |
| 5,816,571 | A | 10/1998 | Chen | |
| 6,244,597 | B1 * | 6/2001 | Matijek | 273/153 S |
| 6,422,559 | B1 | 7/2002 | Utkin | |
| 6,769,690 | B1 | 8/2004 | Khoudary | |
| 6,857,632 | B2 | 2/2005 | Tanner | |
| 7,108,263 | B2 | 9/2006 | Perez et al. | |
| 7,438,290 | B2 * | 10/2008 | Yahyavi | 273/153 S |
| 2005/0269770 | A1 | 12/2005 | Mak | |
| 2007/0057456 | A1 | 3/2007 | Liu | |

FOREIGN PATENT DOCUMENTS

| | | |
|---|---|---|
| WO | WO83/01203 | 4/1983 |

* cited by examiner

*Primary Examiner* — Gene Kim
*Assistant Examiner* — Joseph B Baldori
(74) *Attorney, Agent, or Firm* — Jefim Kirshner

(57) ABSTRACT

A puzzle formed by splitting of a 3-D body by three pairs of symmetrical conical surfaces. The body has a hollow sphere inside with three main axes coincided with the axes of each pair. The elements are a result of splitting by the conical surfaces and comprise outer and inner junction means providing two adjacent elements sliding with respect to each other. There are three types of elements with orientation means: six polar, twelve median and eight triangular elements. The elements adjacent to one conical surface comprise key open means providing elements move apart. The goal of the three-dimensional puzzle is to put the body in right order by 90 degrees rotations of elements spaced from one side of conical surfaces, to the initial ordered orientation, where the body can be separated for two parts providing access to the space located inside the hollow sphere.

16 Claims, 30 Drawing Sheets

THREE-DIMENSIONAL PUZZLE

FIELD OF THE INVENTION

The present invention relates generally to three-dimensional puzzles. More particularly, the present invention relates to 3D puzzles comprise elements rotated in respect to each other to achieve the ordered condition with respect to a shape and color of the corresponding 3D shaped body. The present invention can be use particularly, but not exclusively, as a further development of the famous Rubik's cube family puzzles that significantly increase puzzles attraction.

BACKGROUND OF THE INVENTION

There are numerous designs of puzzles belong to a family of the worldwide famous Rubik's cube. For example, there are known puzzles of this type invented by Erno Rubik and disclosed in the Hungarian Patent HU No. 170062 and U.S. Pat. No. 4,378,116 "A Spatial Logical Toy". Such puzzles comprise elements assembled with spaced inside an intersecting axes member thus forms a 3D shaped body like a three layers cube mainly. The elements form groups of elements each of them have a possibility to rotate around the corresponding axis of the intersecting axes member. The mentioned designs relatively are not simple due to the necessity of the intersecting axes member and, therefore, are costly.

By now, the attraction of such puzzles is practically exhausted because all assembling algorithms are well-known and described, thus, the puzzles attraction is increased in an extensive way by increasing the number of layers. That led to further increasing of the design complexity and cost correspondingly.

There are known puzzles of the mentioned type that have a simplified design, for example, described in the PCT Patent Application WO83/01203 "Three-Dimensional Geometric Puzzle". Such design disclosed a 3D puzzle that comprises only elements form a various 3D shaped body, without the intersecting axes member. Each element has means cooperating with all adjacent elements permitting the sliding of the elements relative to the adjacent elements along an imaginary spherical surface. The means are made as a tongue and groove inter-engagement structure. The puzzle assembling provided by the positioning of each element with the following snapping into place by external pressure. The mentioned 3D puzzle has the same difficulty level during assembling the puzzle like the mentioned above Spatial Logic Toy as well as the assembling algorithms, and therefore, has the same level of the attraction.

Despite the design of the 3D puzzle according to the PCT Patent Application WO83/01203 is more simple, additional problems are arisen. Because the puzzle assembled by applying external pressure, there must be enough clearance at the tongue and groove inter-engagement structure, otherwise some of elements could be destroyed. But such clearance between two adjacent elements summarized with clearances of other elements, that form the group of element which is currently rotated, led to the loss of the shape stability of the group and embarrassed the rotation in respect to other elements.

There is also known puzzle, that provides increasing the puzzle attraction by the possibility to be open if puzzle elements are arranged in the correct order. For example, the U.S. Pat. No. 5,452,895 "Three Dimensional Rotating Puzzle That Open" discloses a spherical puzzle comprises eight fife-sided elements and thirty six-sided elements which are connected by means of a locking rail system that allows all of the elements to be shiftable around the three equatorial planes of the puzzle. According to the mentioned patent the puzzle is hollow inside and can be opened by removing one of the six-sided elements if the elements are arranged in the correct order.

But, despite to the presence of a new feature like opening the puzzle, the attraction of the puzzle in comparison with the mentioned above puzzles is the same or less, depending on the goal of the assembling. If the goal of the puzzle according the U.S. Pat. No. 5,452,895 is the arranging all of the elements in the correct order defined by the colored patterns, the difficulty level will be the same. And, if the goal of the puzzle is the puzzle opening by removing one of the six-sided elements, the difficulty level will be less. In fact, it is evident that the necessity condition for such opening is the arrangement of the element which is opened and the adjacent elements only, in the correct order, all other elements could be arranged at any order. There are a lot of combinations of the arranged elements allowed to open the puzzle that decrease the puzzle difficulty level.

And more, the puzzle design is not simple and the puzzle comprises the small parts like removable rail, which is flush-mounted into the corresponding five-sided element. It will be difficult to catch that removable rail due to the friction; otherwise, if the corresponding clearance will be increased, the removable rail can fall out of the puzzle during the play and lost. The last circumstance is very dangerous if such small part would be swallowed by small-age children.

The main problem of all known three-dimensional puzzles is that all designs can not resolve the contradiction between the tendency to increase the attraction of the puzzle from one hand and the design simplification from the other hand simultaneously.

Therefore, it would be generally desirable to provide a reliable, low cost design of the three-dimensional puzzle that is not complicated and at the same time more attractive in comparison with known 3D puzzles, thus overcome mentioned problems.

SUMMARY OF THE INVENTION

According to the present invention a three-dimensional puzzle comprises of elements formed as a result of splitting of a three-dimensional shaped body by three pairs of coaxial identical right circular conical surfaces. The three-dimensional shaped body has a hollow sphere inside with a center O and three mutually perpendicular main axes OX, OY and OZ, thus defining three main planes XOZ, XOY and YOZ. The axes of each pair coincide with one of the main axes correspondingly. Both conical surfaces of each pair are symmetrical in respect with the center O.

The elements from all sides, being a result of splitting by the conical surfaces, comprise outer and inner junction means that provide for each two adjacent elements to join with the possibility of sliding with respect to each other. All elements contiguous with similar sides of each pair of conical surfaces have outer junction means, while all elements contiguous with the other sides of the same pair of conical surfaces have inner junction means, thus the elements spaced from one side of each conical surface have the possibility to rotate around the axis of the same pair of conical surfaces independently in respect to all other elements.

The elements are three types of elements depending on the shape of the surface belong to the hollow sphere. The elements of the first type are six polar quadrilateral shaped elements crossing by the main axes. The elements of the second type are twelve median rectangular shaped elements spaced between two nearest polar elements. The elements of the third type are eight triangular shaped elements surrounded by three nearest median elements.

The three-dimensional shaped body transformed from initial ordered orientation to disordered orientation by series of 90 degrees rotations of the elements spaced from one side of the conical surfaces in respect to the main axes correspondingly. The outer surface of each elements has coordination means thus define the initial orientation of the elements in respect with the ordered orientation of the three-dimensional shaped body. At the initial orientation of the three-dimensional shaped body the outer and inner junction means of the elements adjacent to one conical surface comprise key open means that provide for each two adjacent elements spaced from both sides of the same conical surface able to move apart with respect to each other in a direction parallel to the axis of the same conical surface, thus all elements spaced from one side of the same conical surface have a possibility to move together along the same direction and the three-dimensional shaped body being separated for two spaced apart parts.

The goal of the three-dimensional puzzle is to put in right order the three-dimensional shaped body from the disordered orientation by series of 90 degrees rotations of the elements spaced from one side of the conical surfaces in respect to the main axes correspondingly, to the initial ordered orientation, where the three-dimensional shaped body has the ability to be separated for two spaced apart parts, thus providing access to the space located inside the hollow sphere. The additional goal is to assemble the three-dimensional shaped body from a disassembled condition where all elements are spaced apart from each other, to the initial ordered orientation.

The preferred embodiment according to the present invention comprises the three-dimensional shaped body made as a cube and the apex angle of each conical surface is equal 180 degrees, thus each of the conical surfaces degenerates to a plane parallel to one of the main planes. Each of the planes spaced aside from the center O at the distance of one-sixth of the length of the edge of the cube substantially, thus provide the equal side lengths of the outer surface of each elements.

According to the other embodiment of the present invention the three-dimensional shaped body is a ball and both conical surfaces of each pair have a common apex. Each of the conical surfaces may have the apex angle of 137 degrees substantially, thus provide the approximately equal side lengths of the outer surface of each elements.

For all embodiments the outer junction means can be made as a ledge protruded along a side part of the elements, and the ledge made as a part of a torus ring integrated by a shorter part of a narrow cylindrical ring with the side part. Correspondingly, the inner junction means can be made as a groove spaced along a side part of the elements, and the groove has the bigger similar cross-section like the ledge, thus the ledge at least partially surrounded by the groove.

The coordination means can be made as colored surfaces with letters and/or numbers. The coordination means can be also made as numbers that form a magic quadrate on each differently colored side of the cube, if the three-dimensional shaped body made as a cube.

The key open means of the ledge can be made by reducing of length of the corresponding ledge for 30%, while the key open means of the corresponding groove are made by deleting of the narrow part of the groove along corresponding length of the key open means of the ledge.

The three-dimensional puzzle may further comprise prize means located with a clearance inside of the hollow sphere. The prize means can be a similar three-dimensional puzzle.

All elements of the three-dimensional puzzle are made from self-lubricated plastic material.

The foregoing and other objectives, features and advantages of the invention will be more readily understood upon consideration of the following detailed description of the invention, taken in conjunction with the accompanying drawings.

DETAILED DESCRIPTION OF PREFERRED EMBODIMENTS

Figure 1:
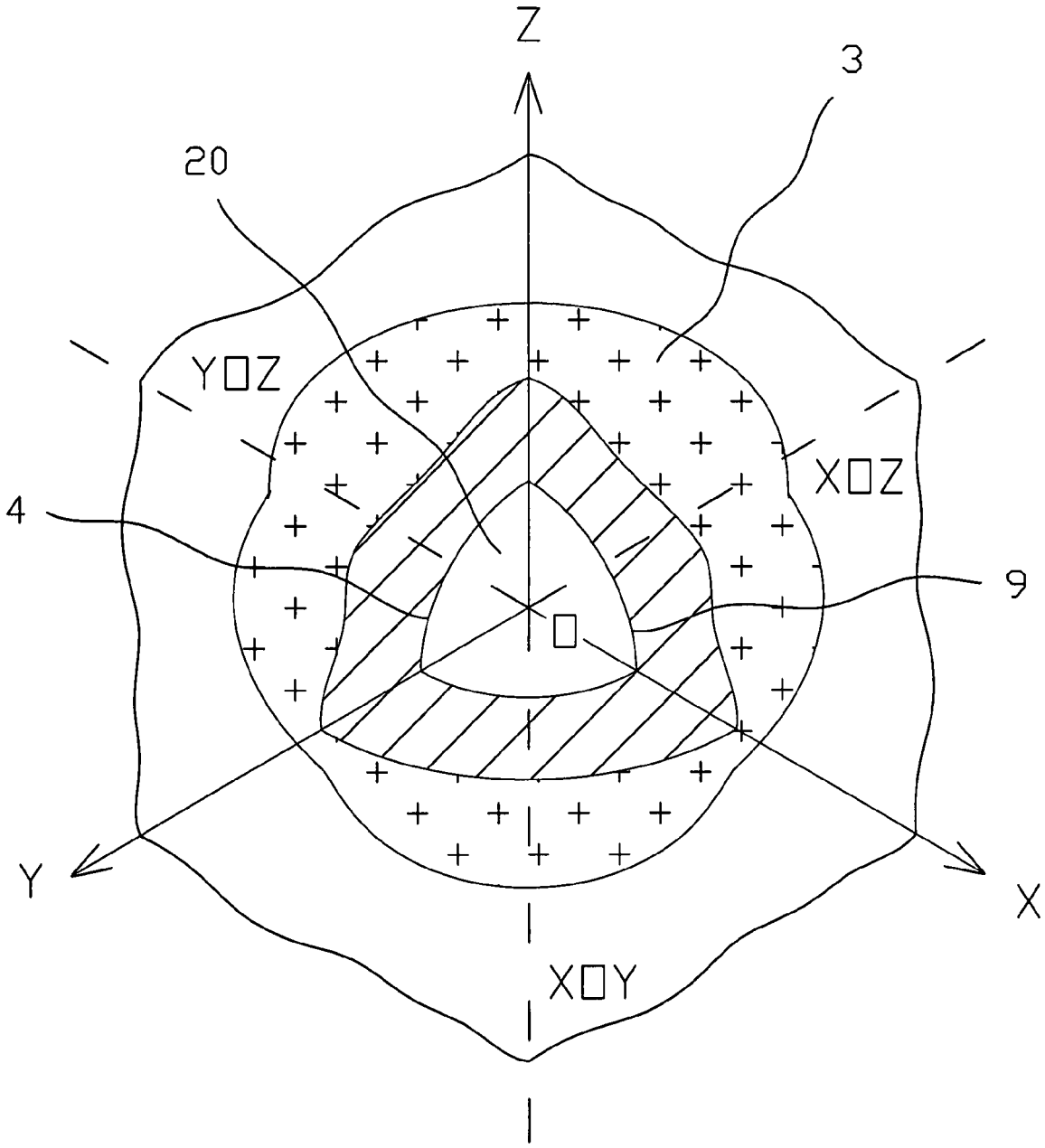
FIG. 1 is a perspective view showing the construction according to the present invention where the three-dimensional shaped body having inside a hollow sphere.
Figure 2:
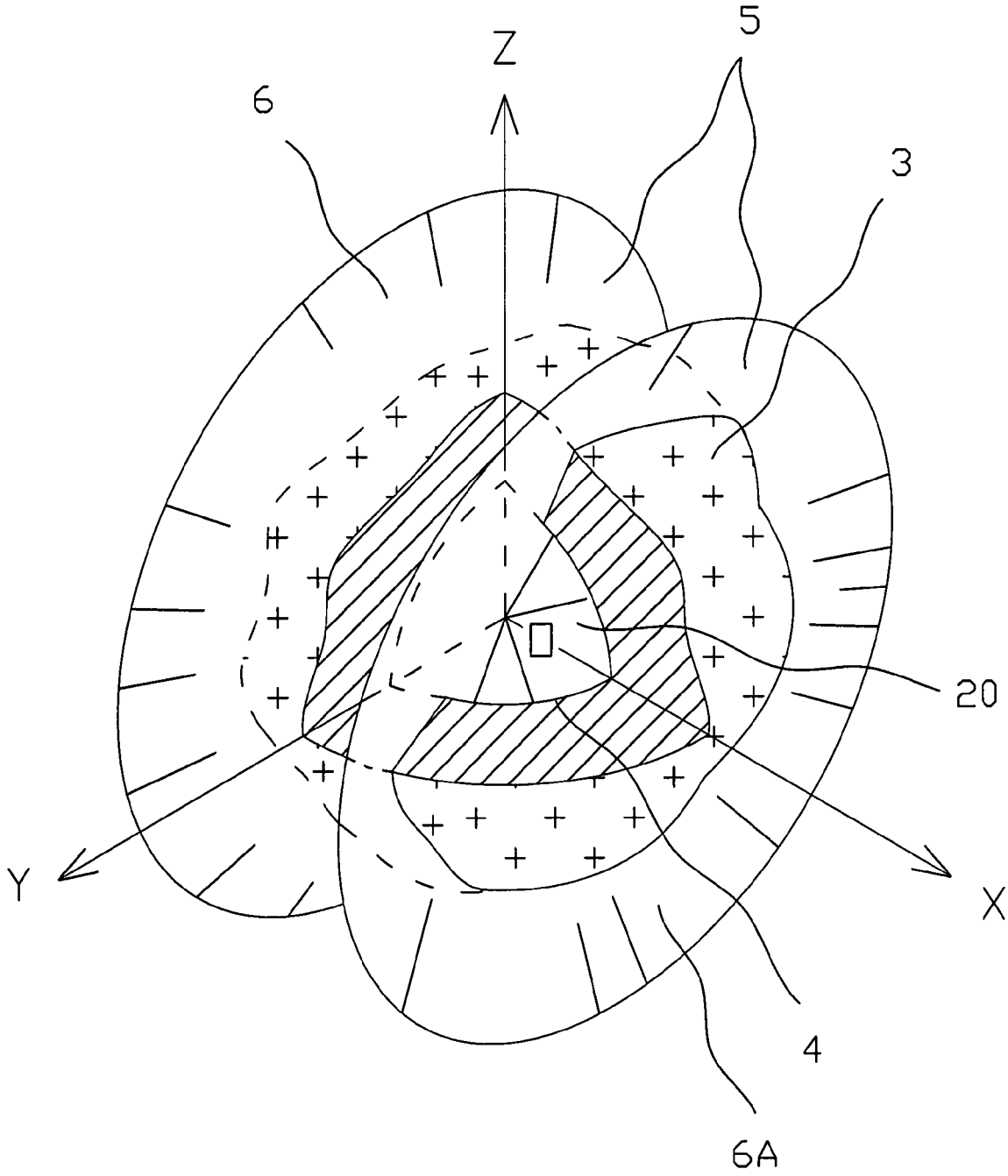
FIG. 2 is a perspective view showing the construction according to the present invention where the three-dimensional shaped body splitted by one pair of the conical surfaces with axis coincided with the main axis OX.
Figure 3:
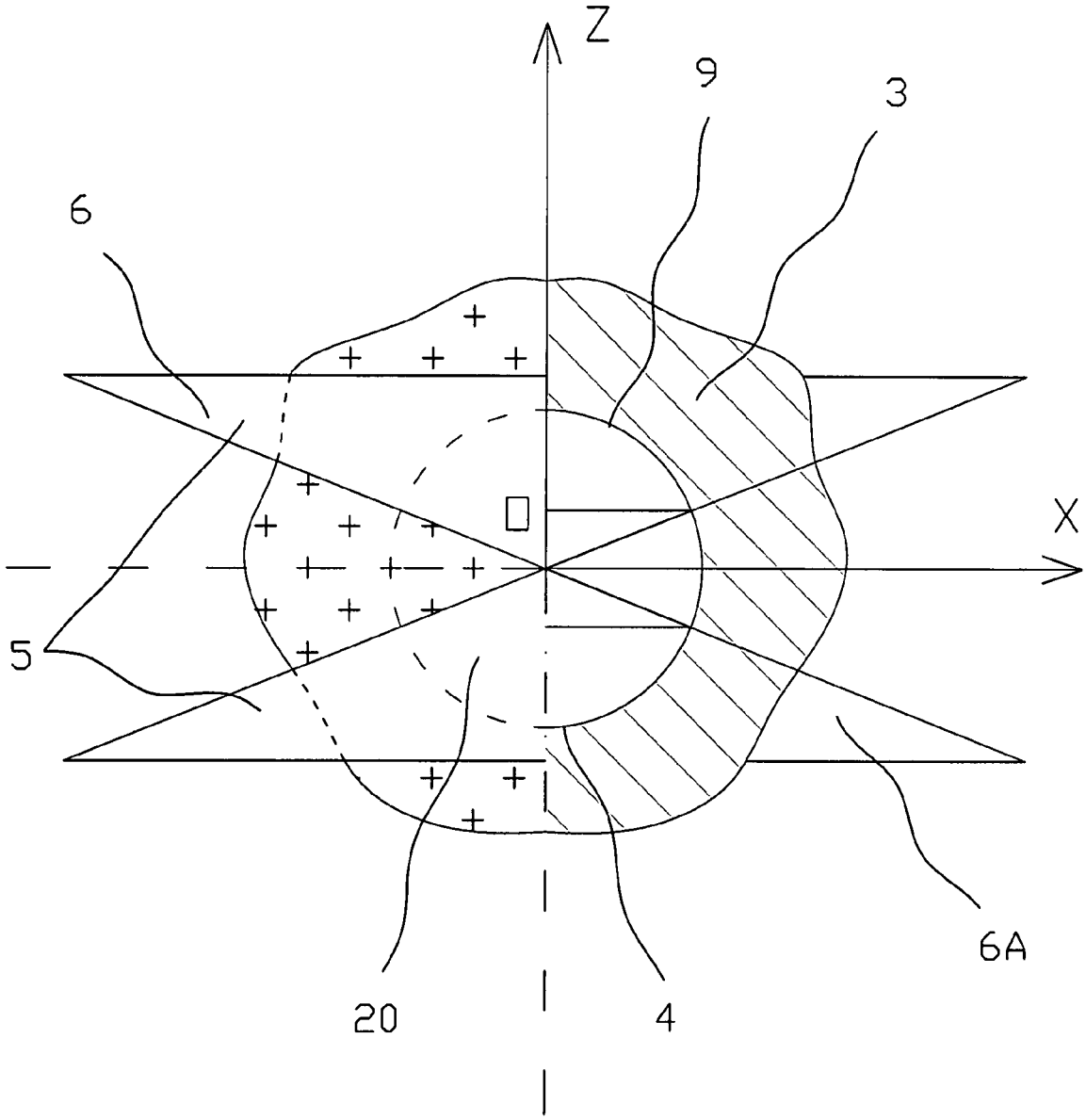
FIG. 3 is a plane front view showing the construction according to the present invention where the three-dimensional shaped body splitted by one pair of the conical surfaces with axis coincided with the main axis OZ.

Preferred embodiment of the present invention will be described in detail below with reference to the accompanying drawings.

FIGS. 1-29 show embodiments of the present invention.

The three-dimensional puzzle 1 comprises of elements 2 formed as a result of splitting of a three-dimensional shaped body 3 by three pairs 5 of coaxial identical right circular conical surfaces 6 (FIGS. 1-6). The three-dimensional shaped body 3 has a hollow sphere 4 inside with a center O and three mutually perpendicular main axes OX, OY and OZ (FIG. 1), thus defining three main planes XOZ, XOY and YOZ. For the simplification only one pair 5 of the conical surfaces 6 and 6A is shown on FIGS. 2 and 3. The axes of each pair 5 coincide with one of the main axes correspondingly. On FIG. 2 the axis of the pair 5 is coincided with the main axes OX, while on FIG. 3 the axis of the pair 5 is coincided with the main axes OZ. Both conical surfaces 6 of each pair 5 are symmetrical in respect with the center O. The three-dimensional shaped body 3 may have numerous shapes, for example, cube, ball, apple-shaped etc.

The elements 2 from all sides being a result of splitting by the conical surfaces 6. Thus, on FIG. 4 the element 2 is a result of splitting the three-dimensional shaped body 3 by the four conical surfaces 6, 6A, 6B and 6C belonging to two pairs 5 and 5A with the axes coincided with the main axes OX and OY correspondingly. On FIG. 5 the element 2 is a result of splitting the three-dimensional shaped body 3 by the four conical surfaces 6, 6A, 6B and 6C. The conical surfaces 6 and 6A belong to the pair 5 with the axis coincided with the main axes OY, while the conical surfaces 6B and 6C belong to the two different pairs 5B and 5C with the axes coincided with the main axes OX and OZ correspondingly. And, on FIG. 6 the element 2 is a result of splitting the three-dimensional shaped body 3 by the three conical surfaces 6, 6A and 6B belonging to the three different pairs 5, 5A and 5B with the axes coincided with the main axes OY, OX and OZ correspondingly.

Figure 4:
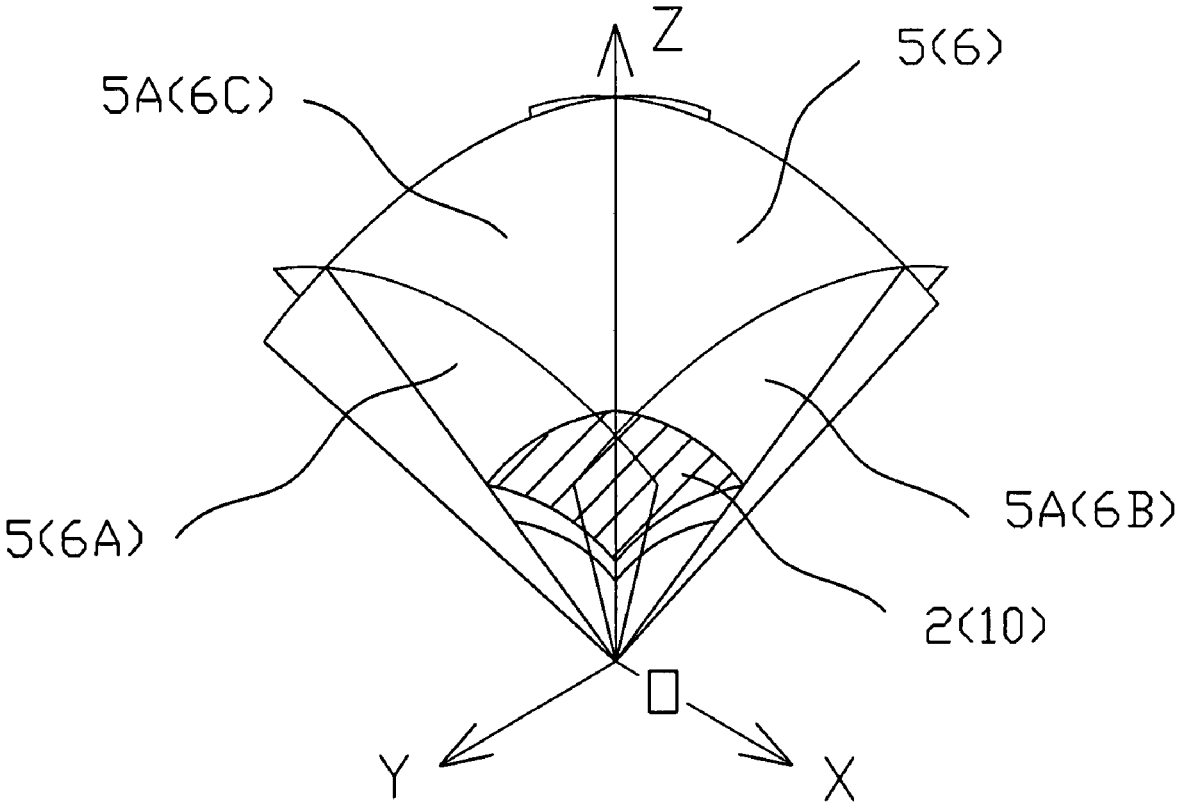
FIG. 4 is a perspective view showing the construction according to the present invention where the polar quadrilateral shaped element is a result of splitting the 3D shaped body by two pairs of the conical surfaces with the axes coincided with the main axes OX and OY.
Figure 4A:
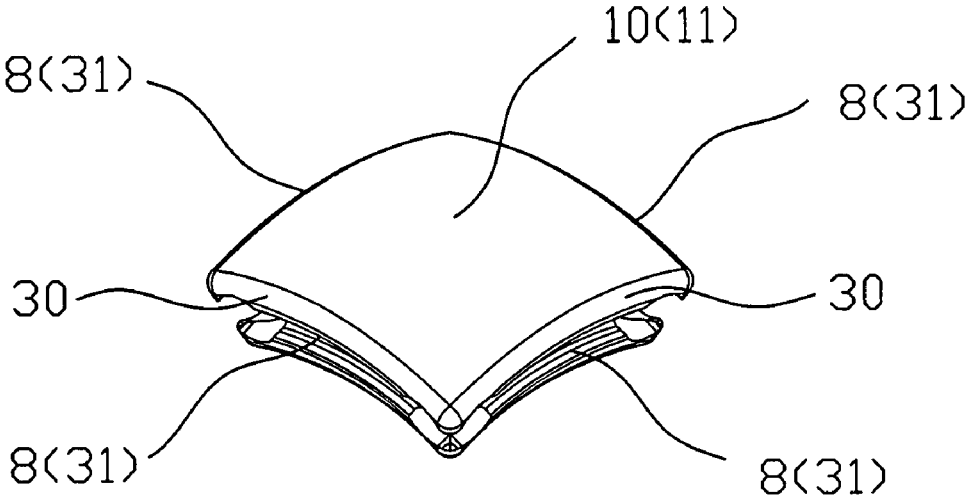
FIG. 4A is a perspective view showing the polar quadrilateral shaped element according to the present invention where the 3D shaped body is a ball.
Figure 5:
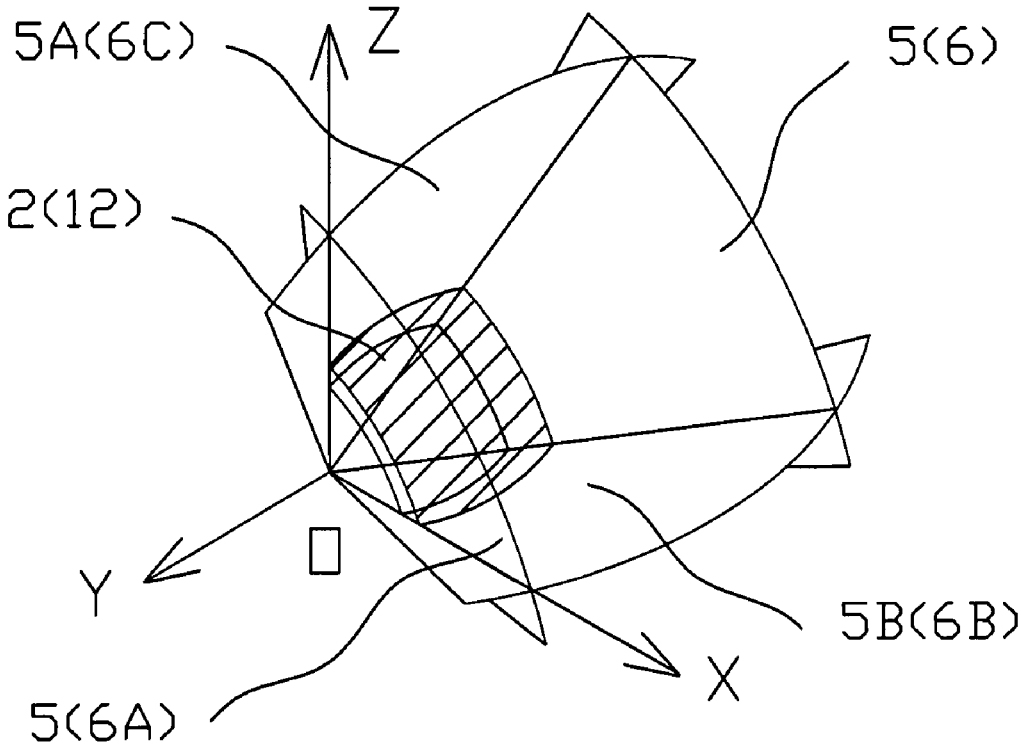
FIG. 5 is a perspective view showing the construction according to the present invention where the median rectangular shaped element is a result of splitting the 3D shaped body by one pair of the conical surfaces with the axis coincided with the main axes OY and by two conical surfaces belong to different pairs with the axis coincided with the main axes OX and OZ.
Figure 5A:
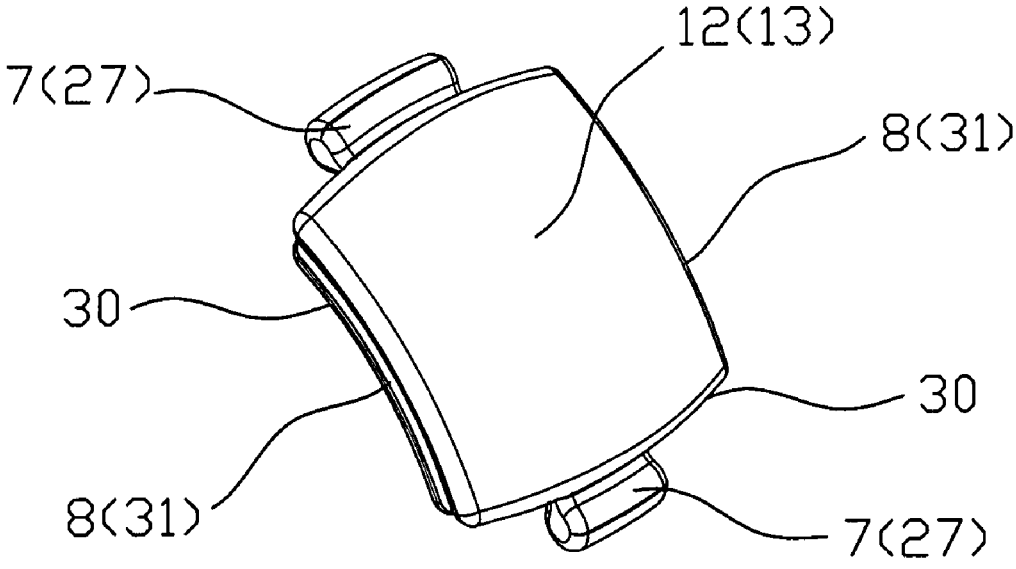
FIG. 5A is a perspective view showing the median rectangular shaped element according to the present invention where the 3D shaped body is a ball.
Figure 6:
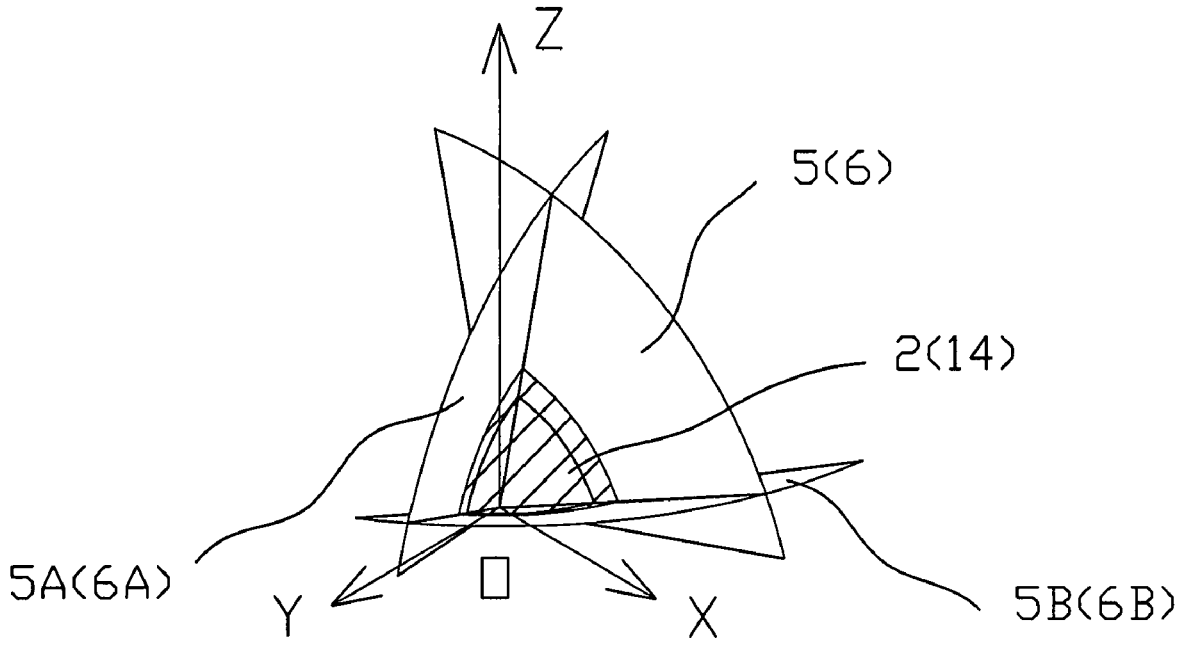
FIG. 6 is a perspective view showing the construction according to the present invention where the triangular shaped element is a result of splitting the 3D shaped body by three conical surfaces belong to different pairs with the axis coincided with the main axes OX, OY and OZ.
Figure 6A:
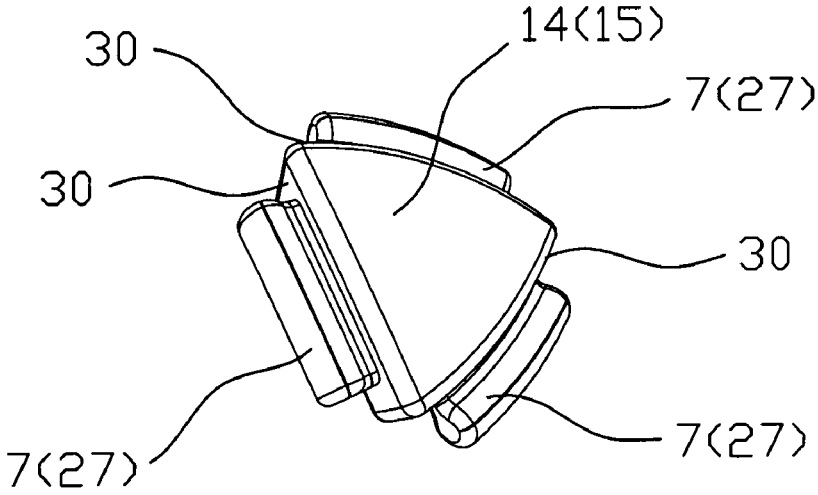
FIG. 6A is a perspective view showing the triangular shaped element according to the present invention where the 3D shaped body is a ball.
Figure 7:
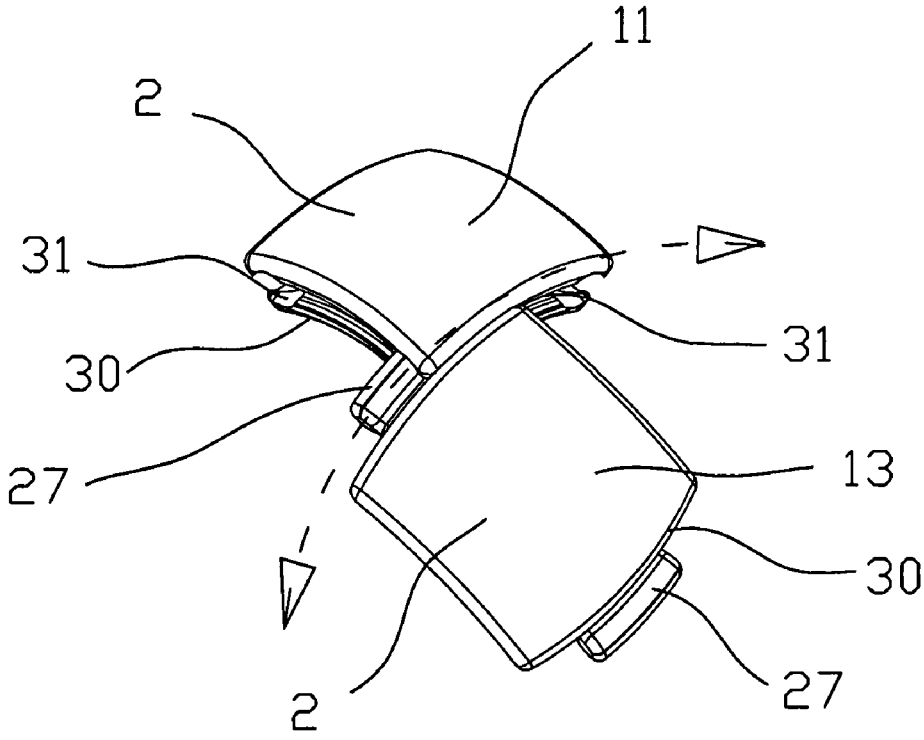
FIG. 7 is a perspective view showing according to the present invention the joining of the polar quadrilateral shaped element and the median rectangular shaped element with the possibility of sliding with respect to each other.
Figure 7A:
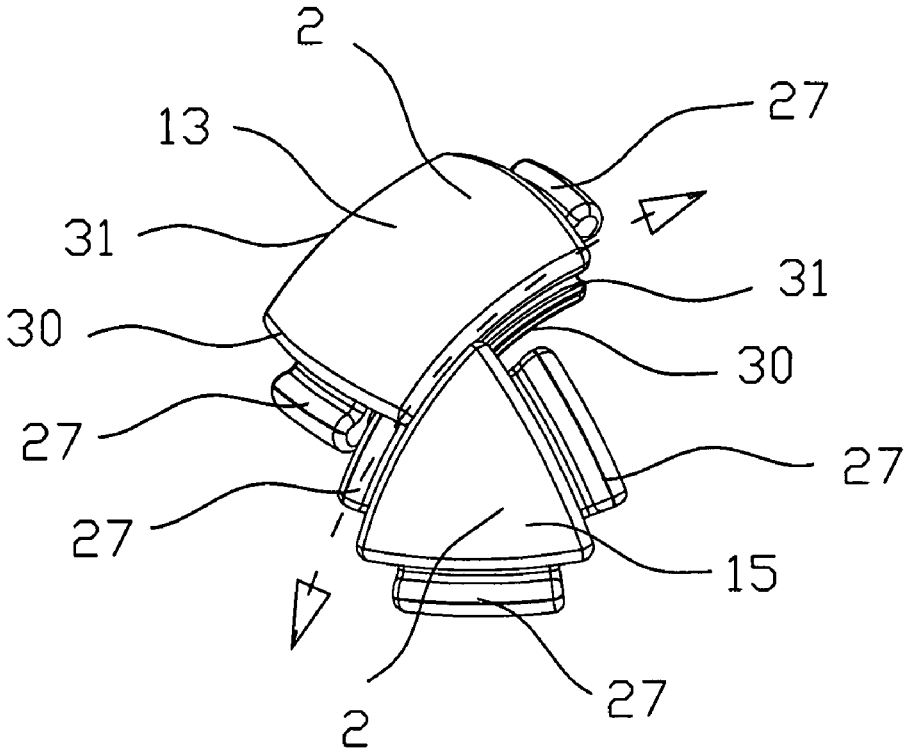
FIG. 7A is a perspective view showing according to the present invention the joining of the median rectangular shaped element and the triangular shaped element with the possibility of sliding with respect to each other.

The elements 2 from all sides, being a result of splitting by the conical surfaces 6, comprise outer and inner junction means 7 and 8 (FIGS. 4A, 5A and 6A), which provide for each two adjacent elements 2 to join with the possibility of sliding with respect to each other (FIGS. 7 and 7A). All elements 2 contiguous with similar sides of each pair 5 of the conical surfaces 6 have outer junction means 7, while all elements 2 contiguous with the other sides of the same pair 5 of the conical surfaces 6 have inner junction means 8, thus the elements 2 spaced from one side of each conical surface 6 have the possibility to rotate around the axis of the same pair 5 of the conical surfaces 6 independently in respect to all other elements 2.

Figure 8:
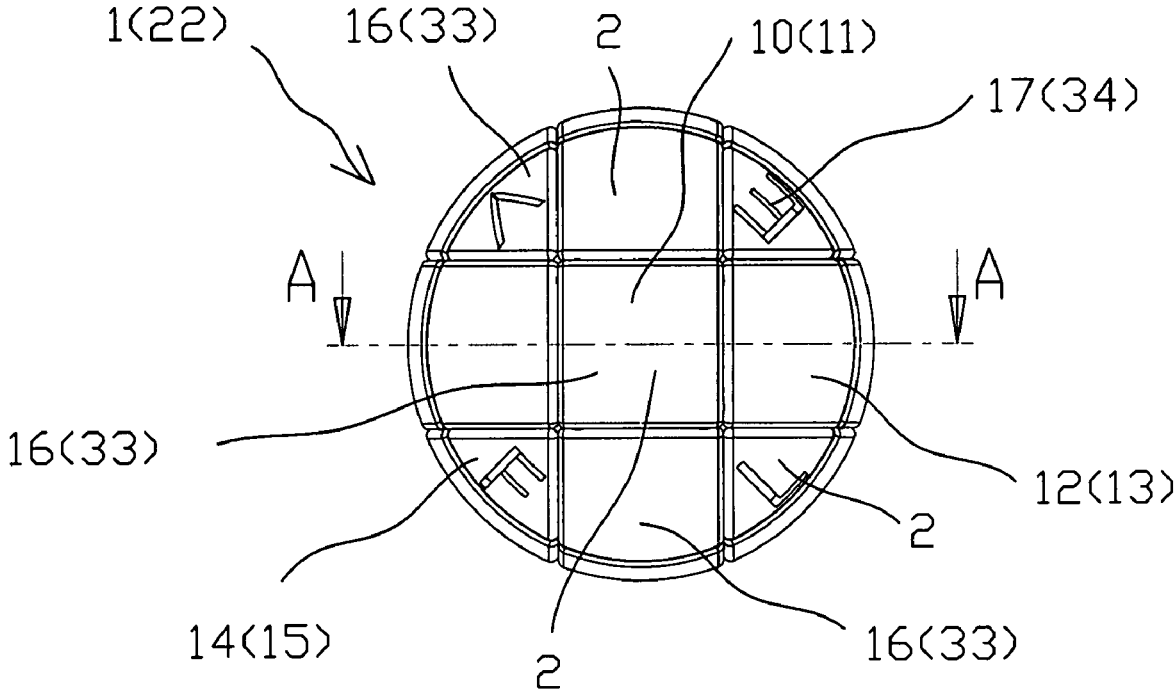
FIG. 8 is a plane top view showing the second embodiment of the present invention where the 3D shaped body is a ball.
Figure 8A:
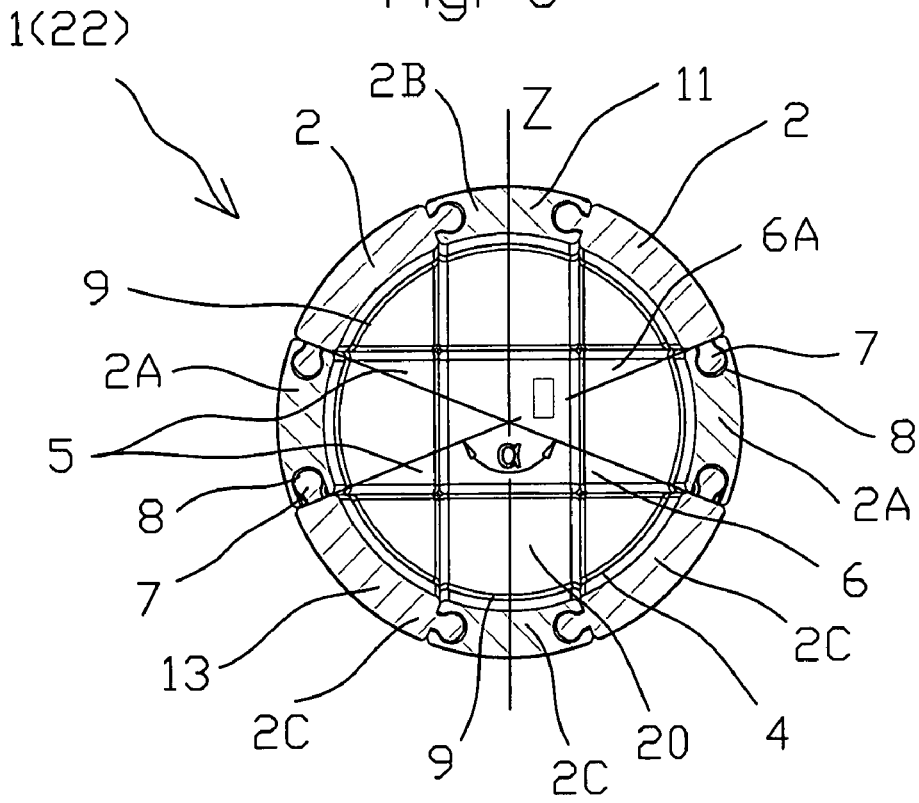
FIG. 8A is a sectional view along sectional plane A-A from FIG. 8.
Figure 9:
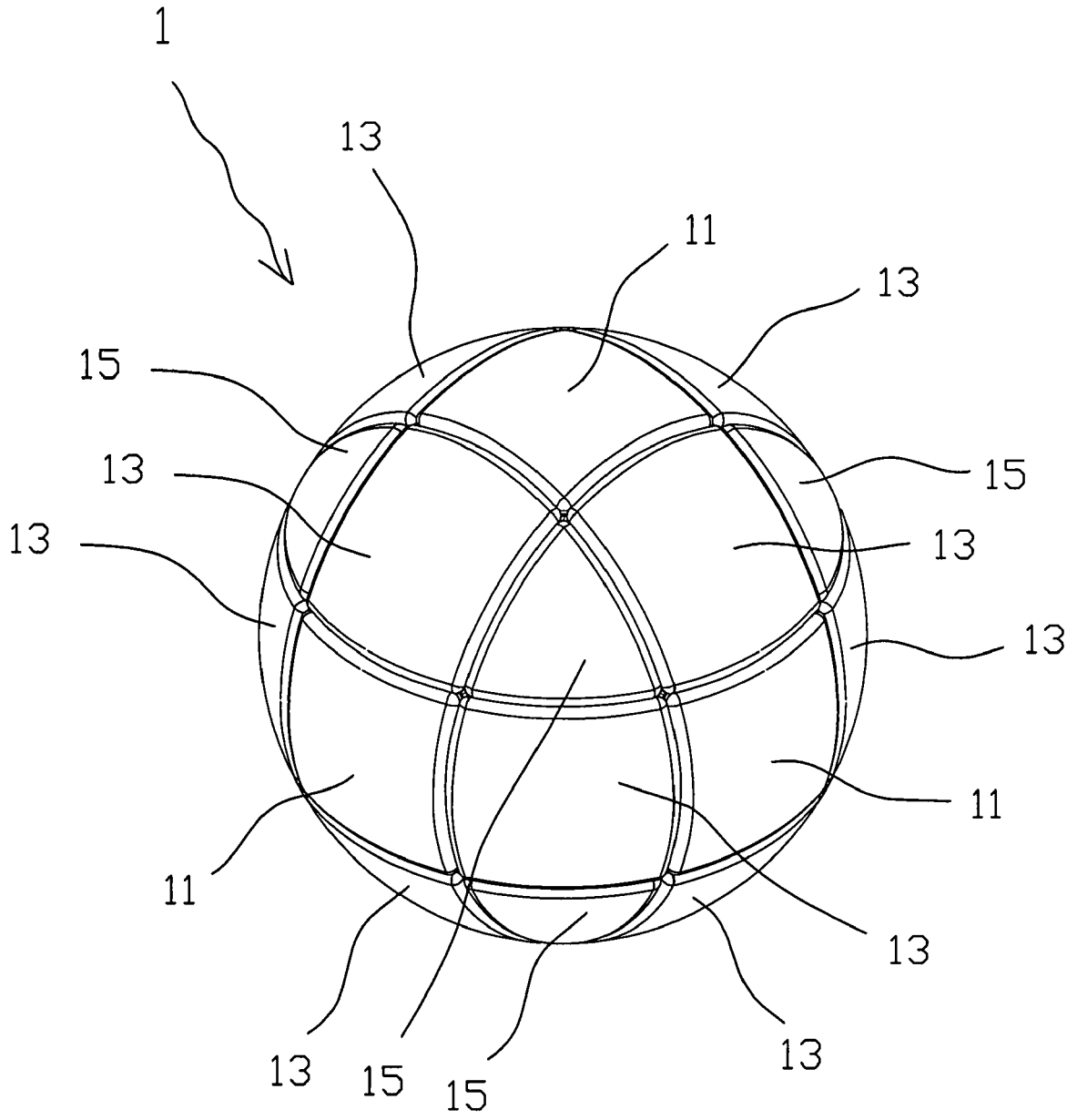
FIG. 9 is a perspective view showing the second embodiment of the present invention where the 3D shaped body is a ball. The coordination means are not shown.
Figure 10:
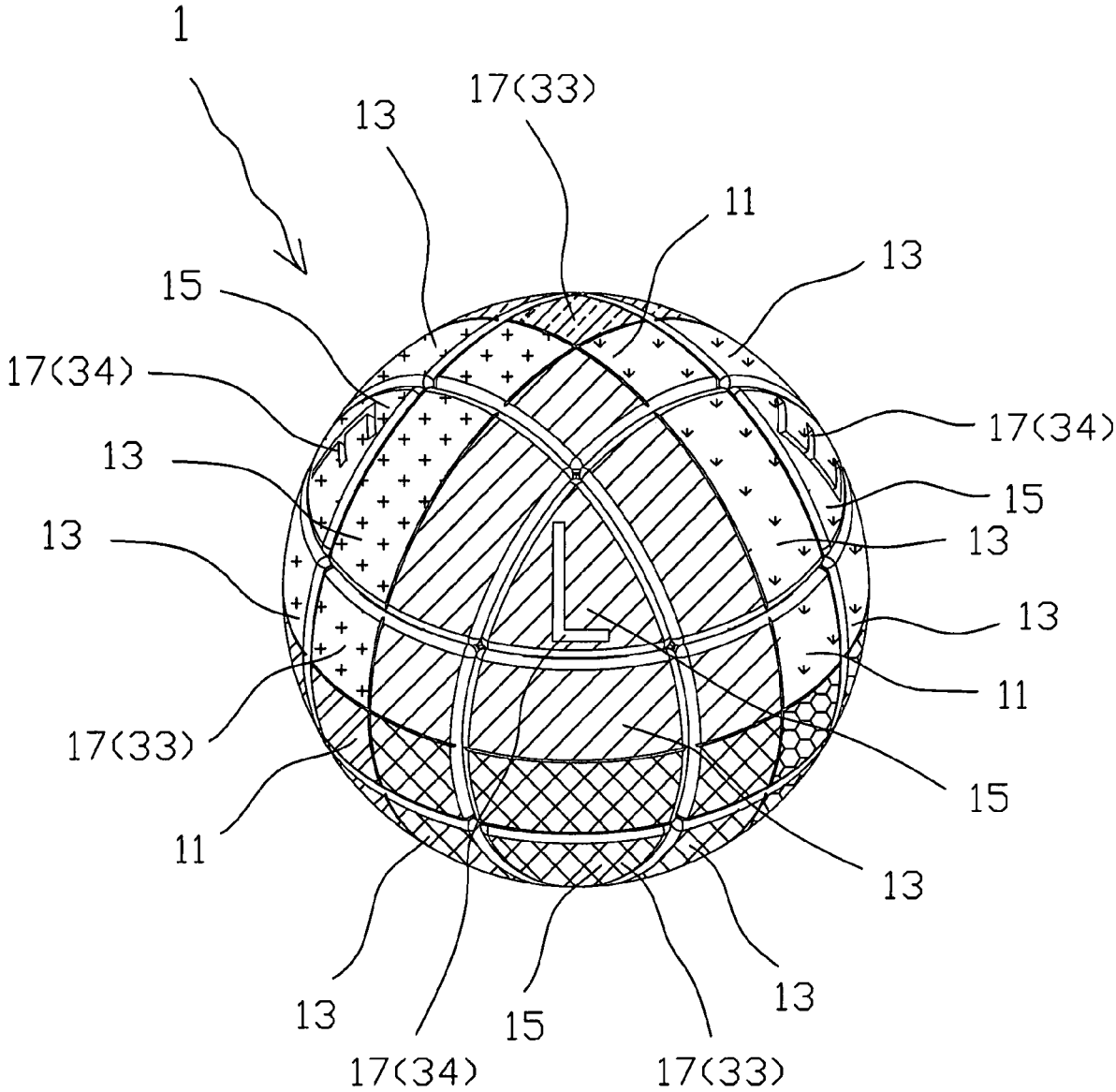
FIG. 10 is a perspective view showing the second embodiment of the present invention at the initial ordered orientation.
Figure 11:
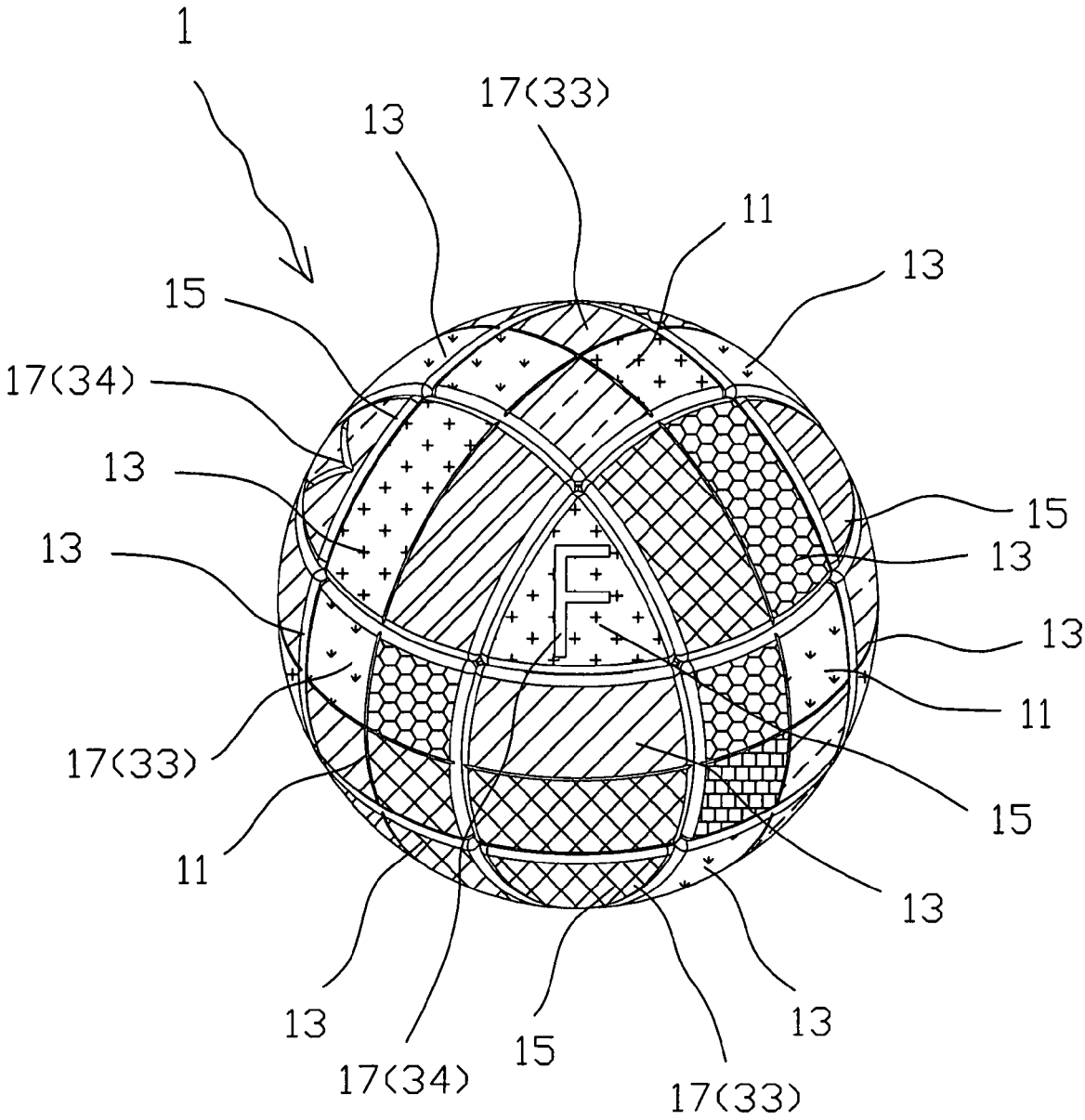
FIG. 11 is a perspective view showing the second embodiment of the present invention at the disordered orientation.
Figure 12:
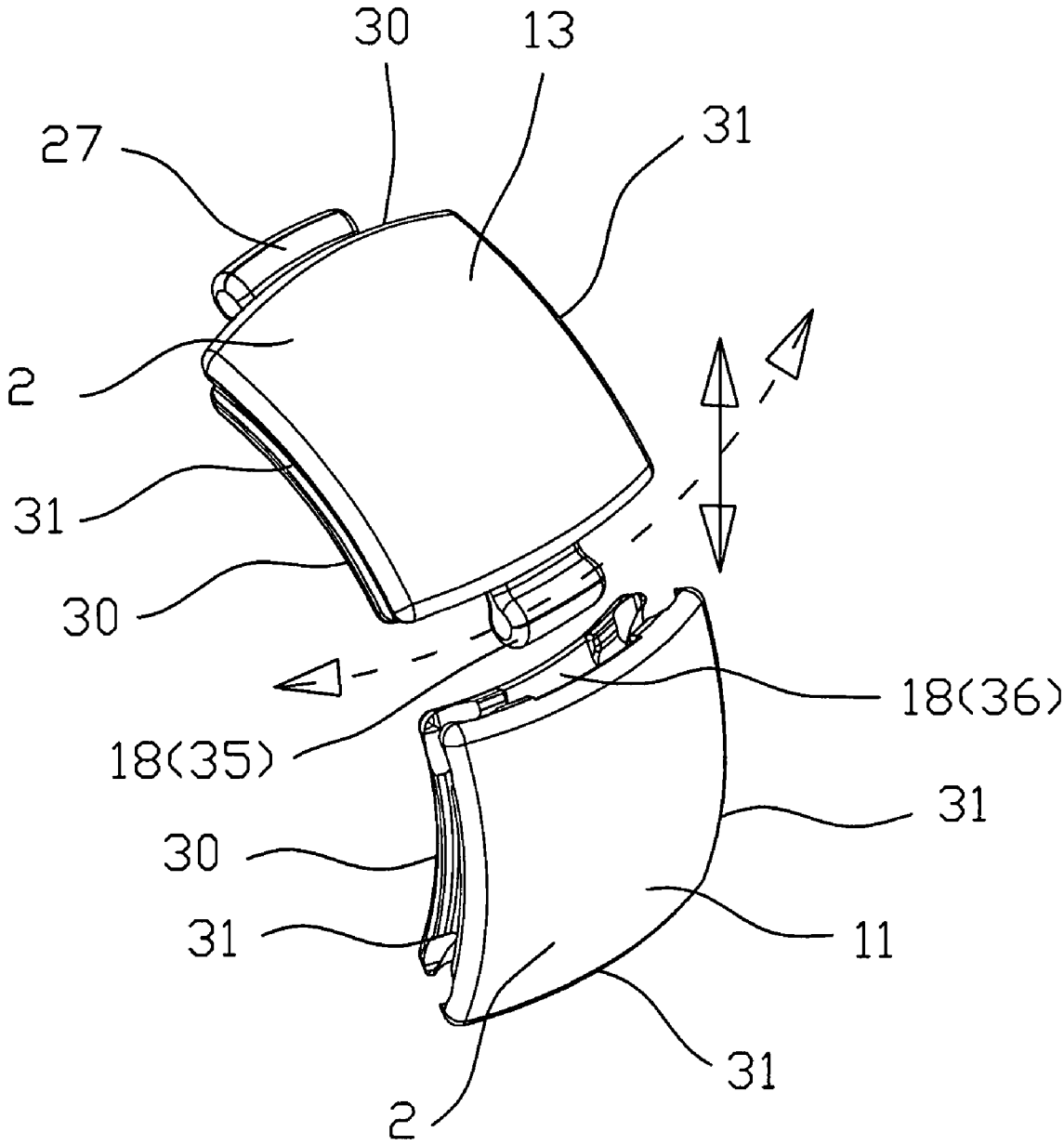
FIG. 12 is a perspective view showing according to the present invention the joining of the polar quadrilateral shaped element and the median rectangular shaped element with the possibilities of sliding and moving apart with respect to each other.
Figure 13:
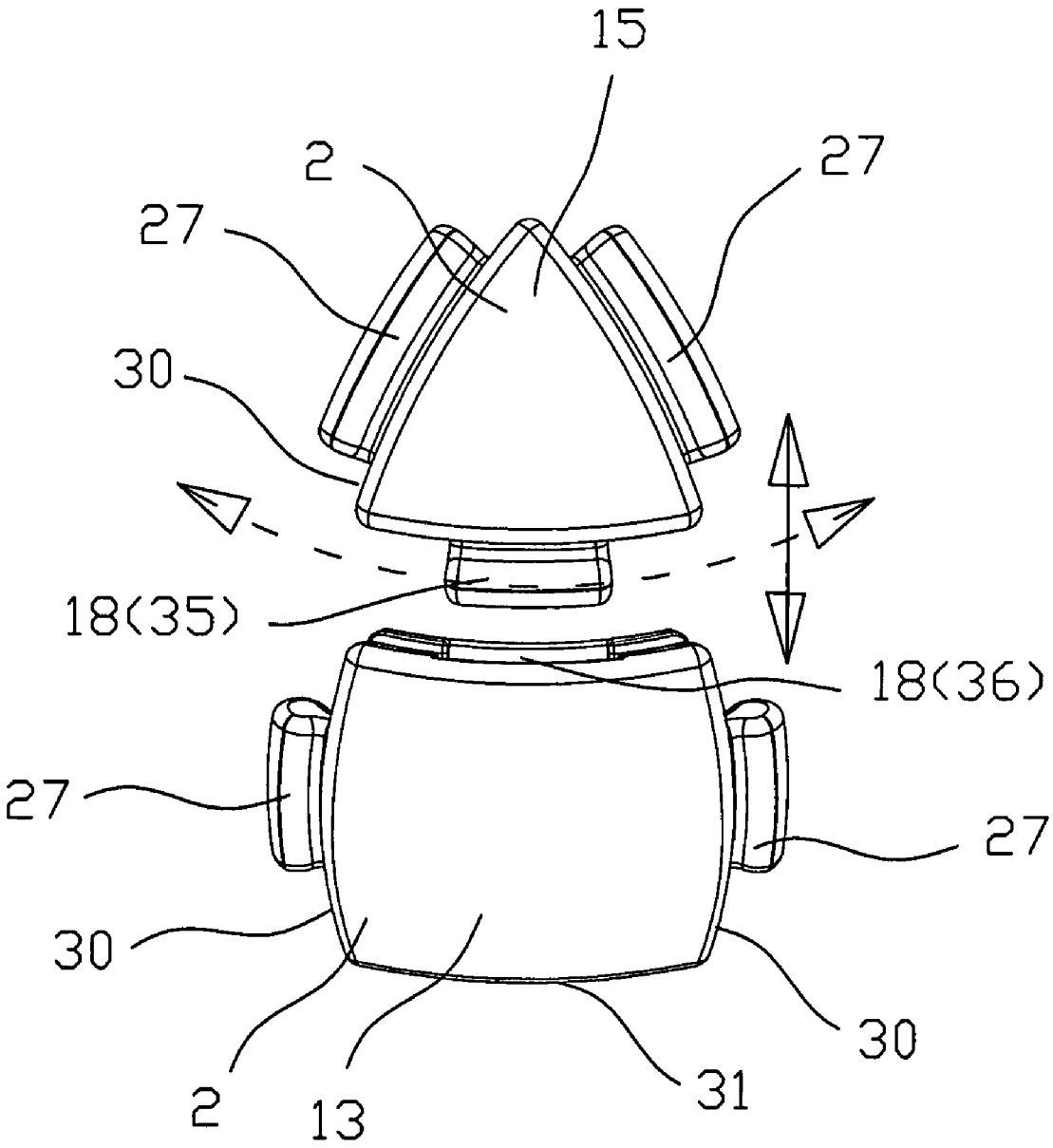
FIG. 13 is a perspective view showing according to the present invention the joining of the triangular shaped element and the median rectangular shaped element with the possibilities of sliding and moving apart with respect to each other.

This is illustrated on FIG. 8A, where all elements 2 and 2C correspondingly contiguous with the similar inner sides of the conical surfaces 6A and 6 of the pair 5 with the axis coincided with the main axis OZ, have the outer junction means 7. And, all elements 2A contiguous with the other outer sides of the conical surfaces 6 and 6A of the same pair 5 have the inner junction means 8. Therefore, the elements 2 and 2B spaced from one side of the conical surface 6A have the possibility to rotate around the axis OZ of the same pair 5 independently in respect to all other elements 2A and 2C. At the same time the elements 2C spaced from one side of the conical surface 6 have the possibility to rotate around the same axis OZ of the same pair 5 independently in respect to all other elements 2, 2A and 2B. It is evident, that the outer junction means 7 and the inner junction means 8 can be mutually switched, keeping the same possibility of the rotation around the axis OZ (FIG. 16A).

The elements 2 are three types of elements 10, 12 and 14 (FIGS. 4-8A) depending on the shape of the surface 9 belong to the hollow sphere 4. The elements of the first type 10 are six polar quadrilateral shaped elements 11 (FIG. 9) crossing by the main axes OX, OY and OZ. The elements of the second type 12 are twelve median rectangular shaped elements 13 spaced between two nearest polar elements 11. The elements of the third type 14 are eight triangular shaped elements 15 surrounded by the three nearest median elements 13.

Figure 14:
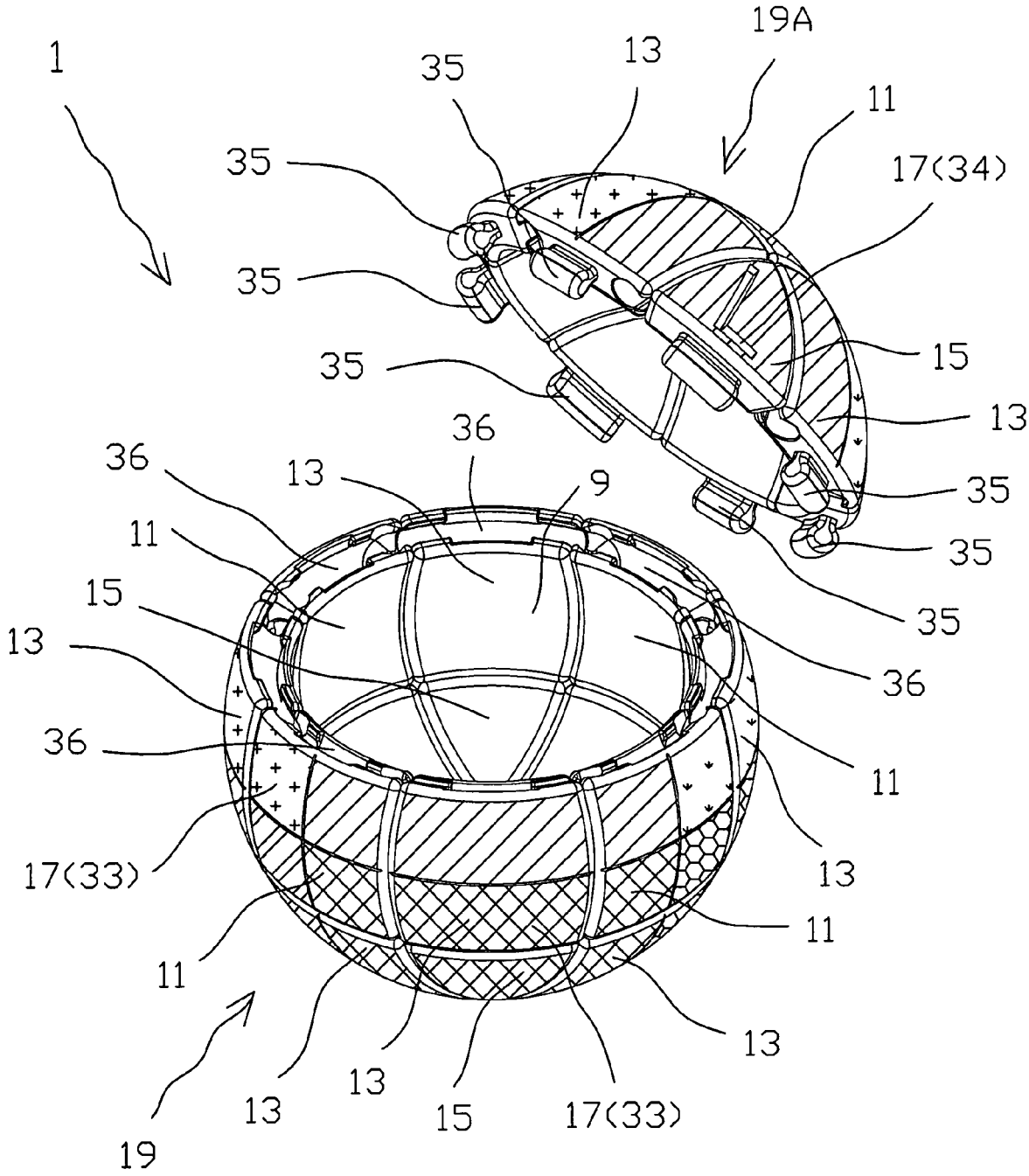
FIG. 14 is a perspective view showing the second embodiment of the present invention where the three-dimensional shaped body being separated for two spaced apart parts.
Figure 15:
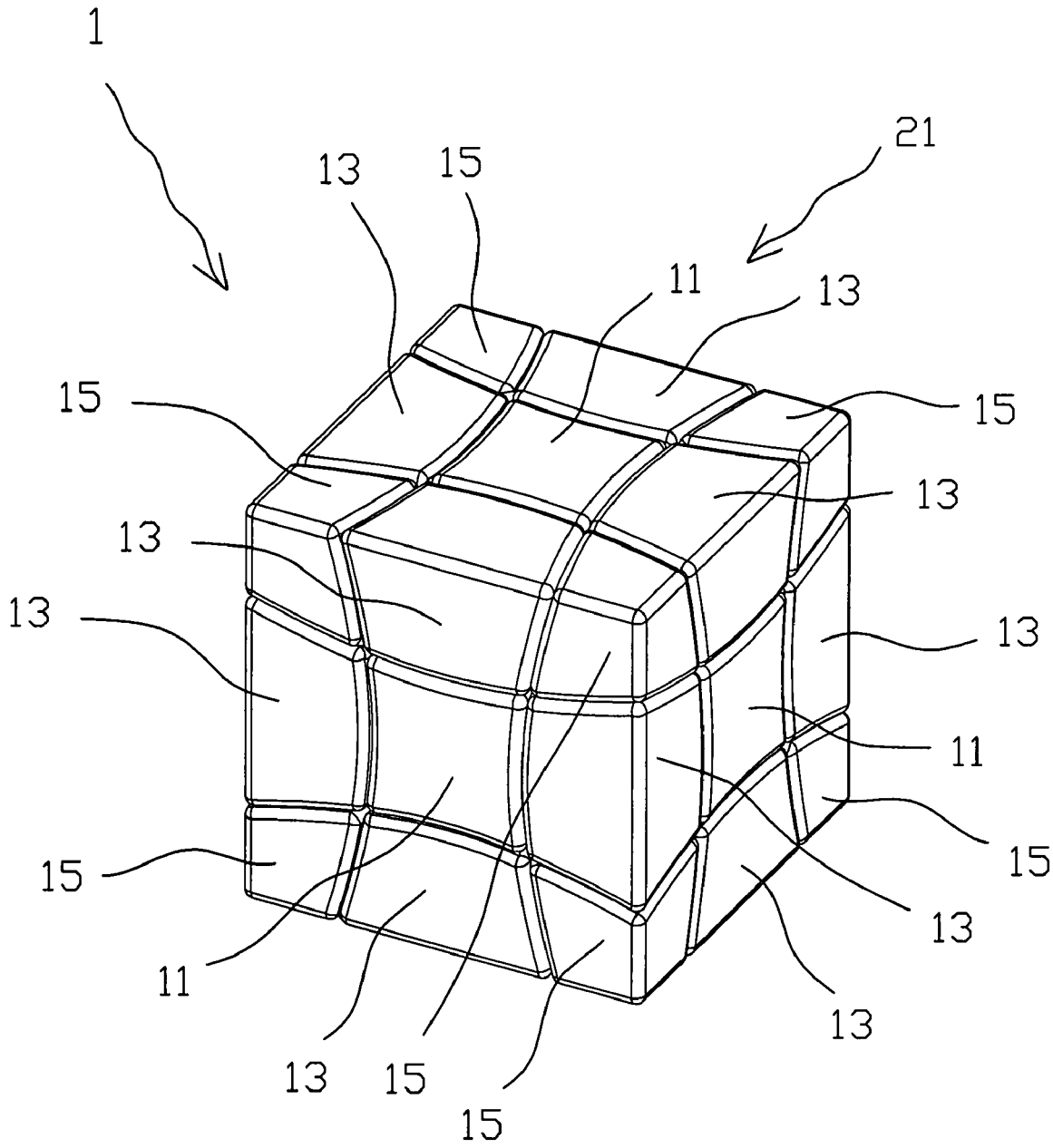
FIG. 15 is a perspective view showing the first embodiment of the present invention where the 3D shaped body is a cube splitted by the conical surfaces. The coordination means are not shown.
Figure 17:
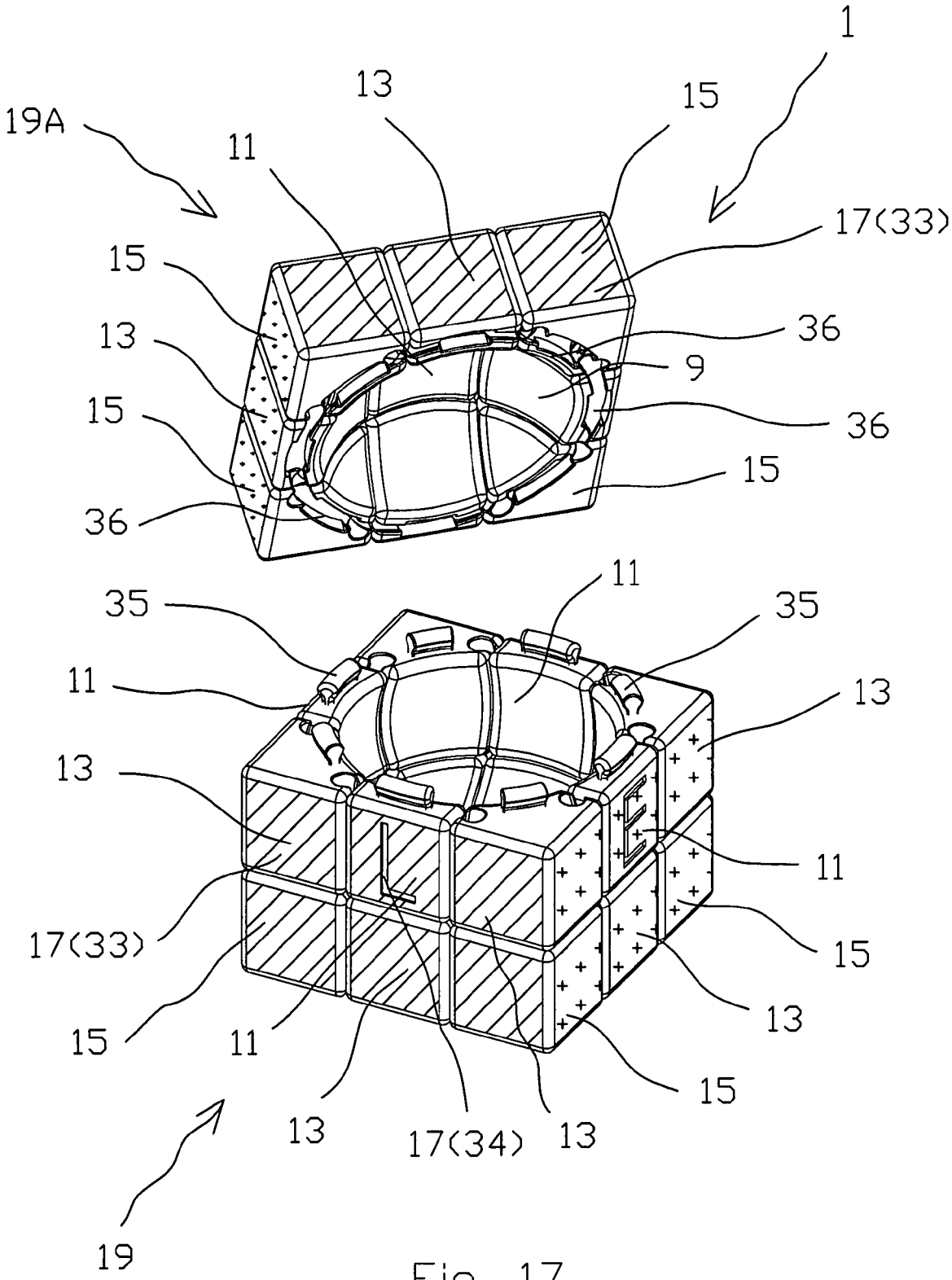
FIG. 17 is a perspective view showing the preferred embodiment of the present invention where the three-dimensional shaped body being separated for two spaced apart parts.
Figure 21:
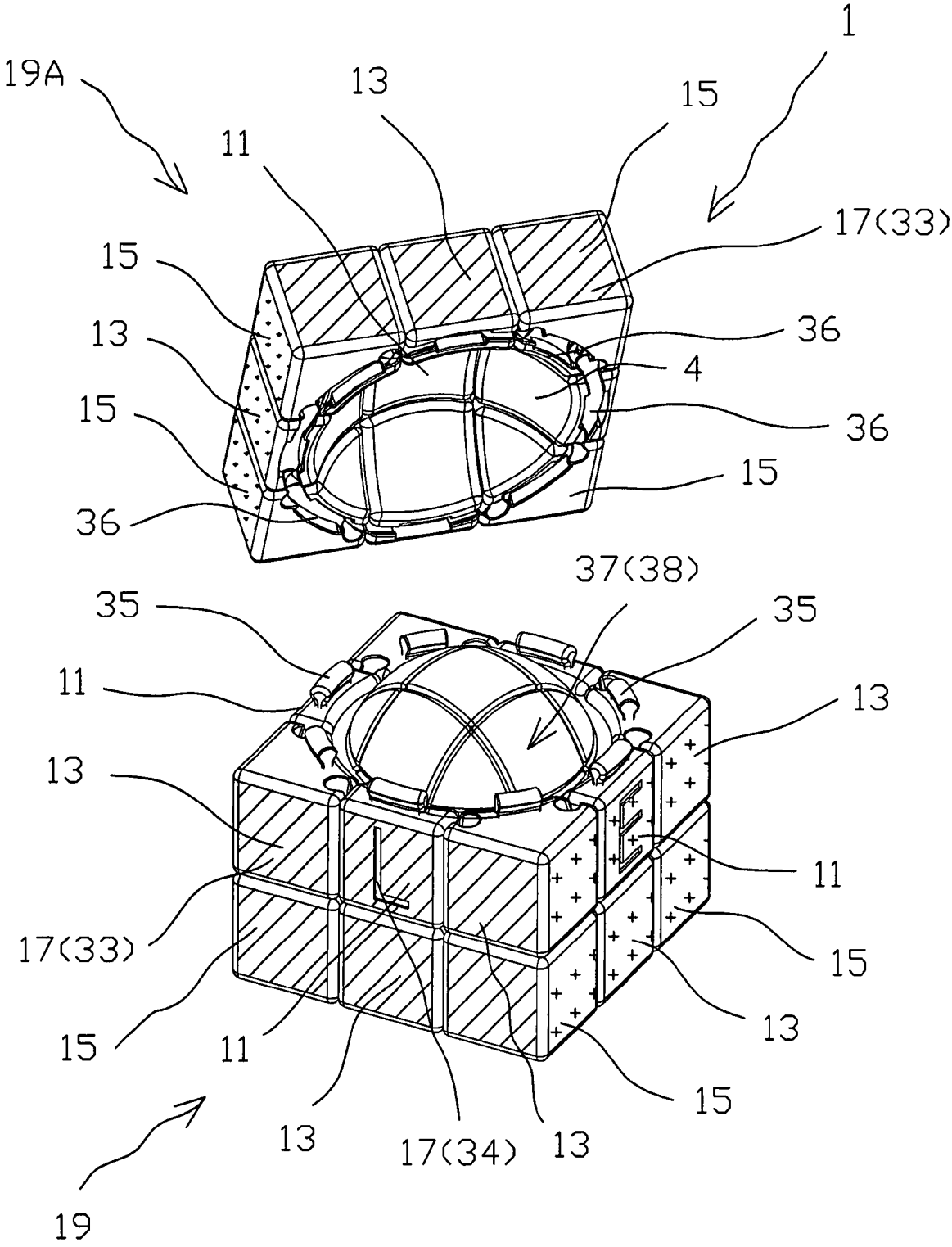
FIG. 21 is a perspective view showing the preferred embodiment of the present invention where the three-dimensional shaped body being separated for two spaced apart parts and there is a similar three-dimensional puzzle located inside of the hollow sphere.

The three-dimensional shaped body 3 can be transformed from the initial ordered orientation (FIGS. 10, 14, 16 and 19) to the disordered orientation (FIG. 11) by series of 90 degrees rotations of the elements 2 spaced from one side of the conical surfaces 6 in respect to the main axes OX, OY and OZ correspondingly. The outer surfaces 16 of each elements 2 (FIGS. 8 and 16) have coordination means 17 thus define the initial orientation of the elements 2 in respect with the ordered orientation of the three-dimensional puzzle 1. At the initial orientation of the three-dimensional puzzle 1 the outer and inner junction means 7 and 8 of the elements 2 adjacent to the one conical surface 6 comprise key open means 18 that provide for each two adjacent elements 2 spaced from the both sides of the same conical surface 6 able to move apart with respect to each other in direction parallel to the axis of the same conical surface 6 (FIGS. 12 and 13), thus all elements 2 spaced from one side of the same conical surface 6 have a possibility to move together along the same direction and the three-dimensional puzzle 1 being separated for two spaced apart parts 19 and 19A (FIGS. 14, 17 and 21).

Figure 16:
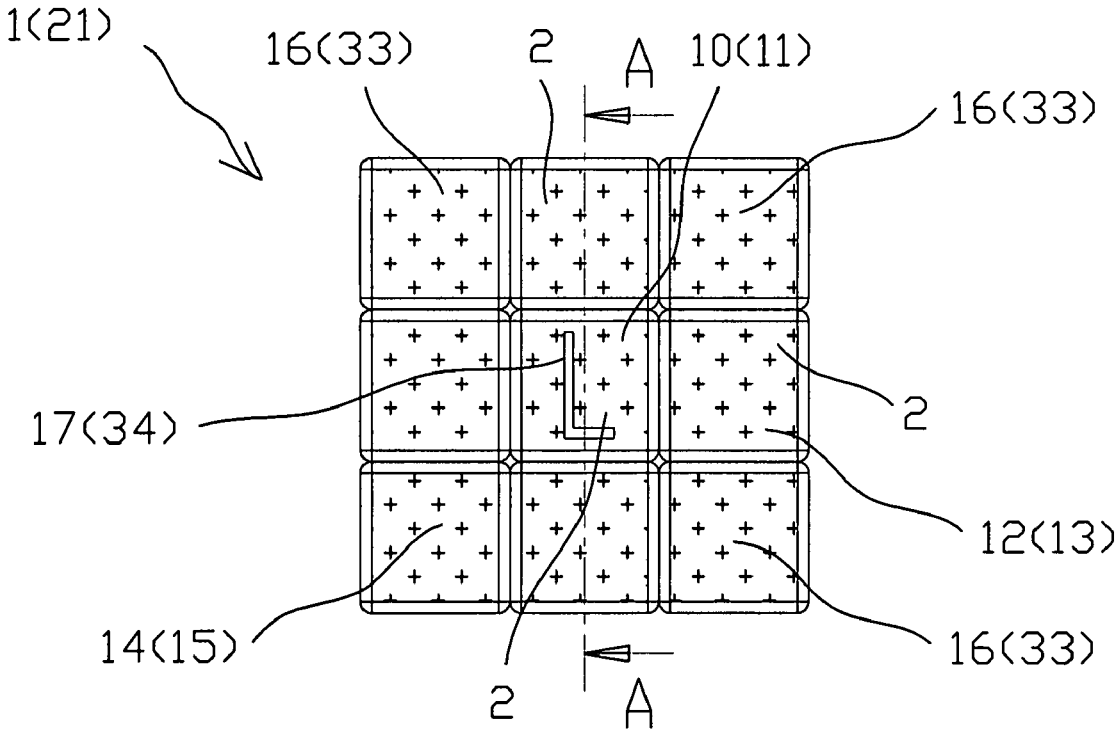
FIG. 16 is a plane top view showing the preferred embodiment of the present invention where the 3D shaped body is a cube and the conical surfaces degenerate to planes parallel to the corresponding main planes.
Figure 16A:
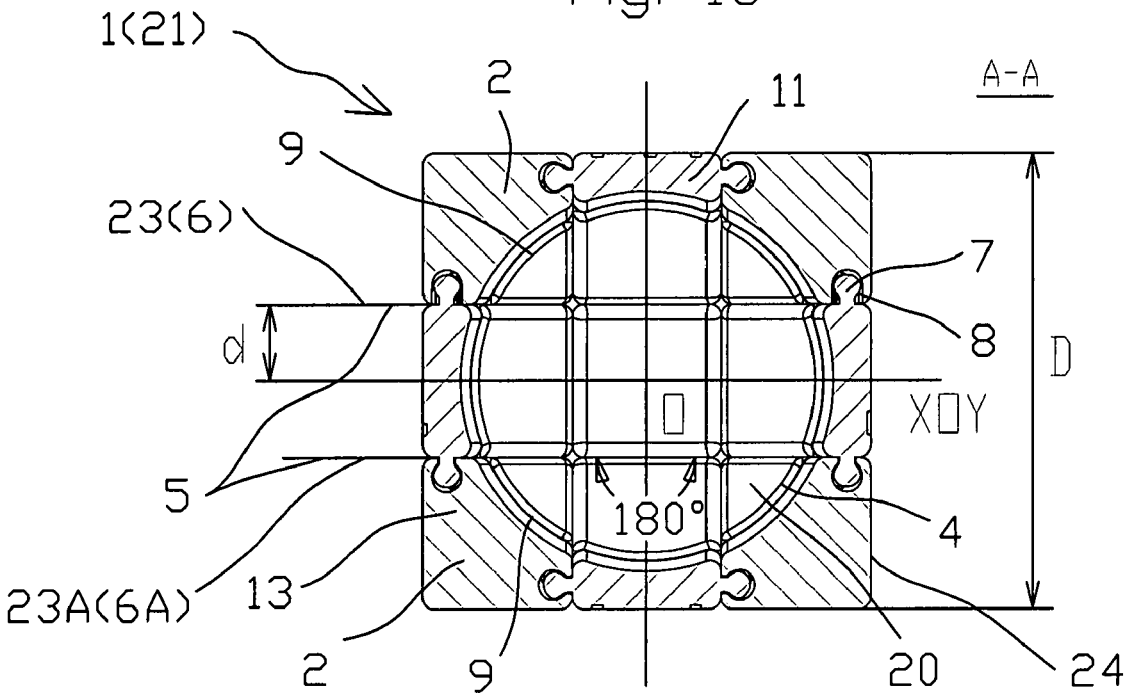
FIG. 16A is a sectional view along sectional plane A-A from FIG. 16.

The goal of the three-dimensional puzzle 1 is to put in right order the three-dimensional shaped body 3 from the disordered orientation (FIG. 11) by series of 90 degrees rotations of the elements 2 spaced from one side of the conical surfaces 6 in respect to the main axes OX, OY and OZ correspondingly, to the initial ordered orientation (FIGS. 10, 14, 16 and 19), where the three-dimensional shaped body 3 has the ability to be separated for two spaced apart parts 19 and 19A (FIGS. 14, 17 and 21), thus providing access to the space 20 located inside the hollow sphere 4 (FIGS. 8A and 16A). The additional goal is to assemble the three-dimensional shaped body 3 from a disassembled condition (FIGS. 24 and 25) where all elements 2 are spaced apart from each other, to the initial ordered orientation (FIGS. 10, 14, 16 and 19).

The preferred embodiment according to the present invention comprises the three-dimensional shaped body 3 made as a cube 21 (FIGS. 15-16A and 19) and the apex angle of each conical surface is equal 180 degrees (FIGS. 16 and 16A), thus each of the conical surfaces 6 degenerates to a plane 23 parallel to one of the main planes XOY, XOZ and YOZ correspondingly. Each of the planes 23 spaced aside from the center O at the distance d of one-sixth of the length D of the edge 24 of the cube 21 substantially, thus provide the equal side lengths of the outer surface 16 of each elements 2. On FIG. 16A the conical surfaces 6 and 6A of the pair 5 correspondingly degenerate to the planes 23 and 23A parallel to the main plane XOY.

According to the second embodiment of the present invention the three-dimensional shaped body 3 is a ball (FIGS. 8-11 and 14) and both conical surfaces 6 of each pair 5 have a common apex. In common case both conical surfaces 6 of each pair 5 may have non-coincided apexes. Each of the conical surfaces 6 may have the apex angle $\alpha$ of 137 degrees substantially, thus provide the approximately equal side lengths of the outer surface 16 of each of the elements 2.

Figure 18:
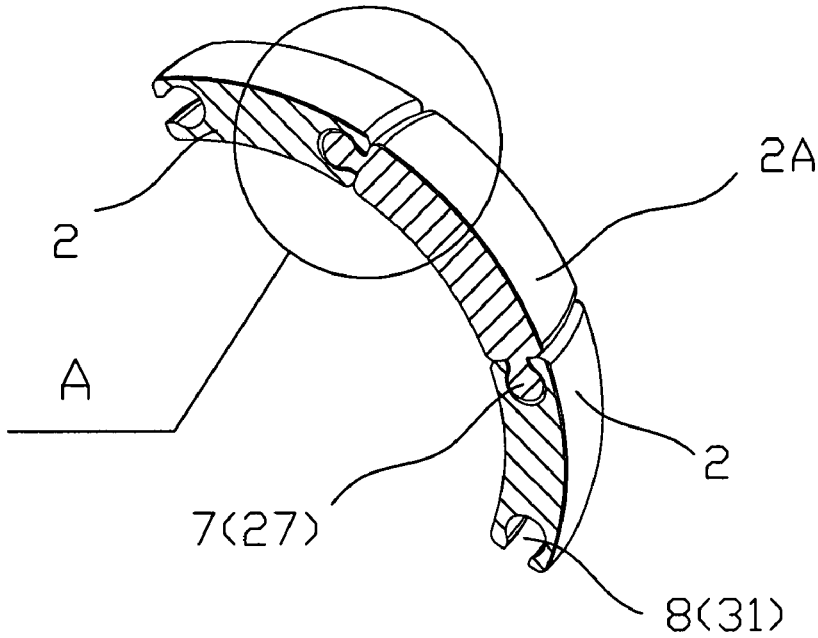
FIG. 18 is a sectional perspective view showing the outer and inner junction means made as ledges and grooves according to the present invention.
Figure 18A:
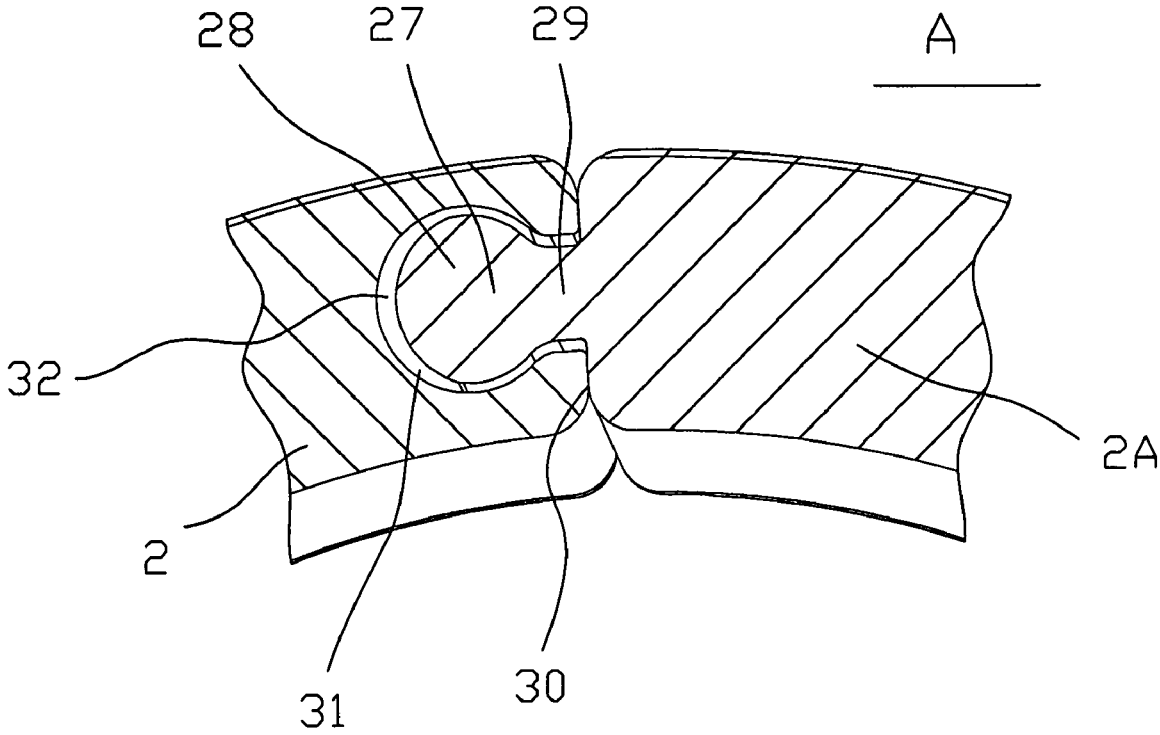
FIG. 18A is an enlarged sectional side view A from FIG. 18.
Figure 20:
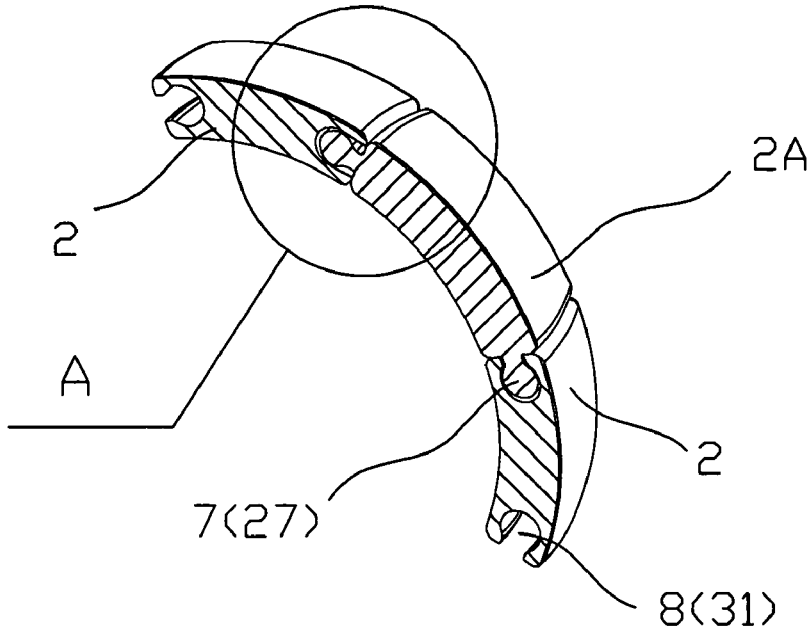
FIG. 20 is a sectional perspective view showing the key open means of the inner junction means made by deleting of the narrow part of the groove.
Figure 20A:
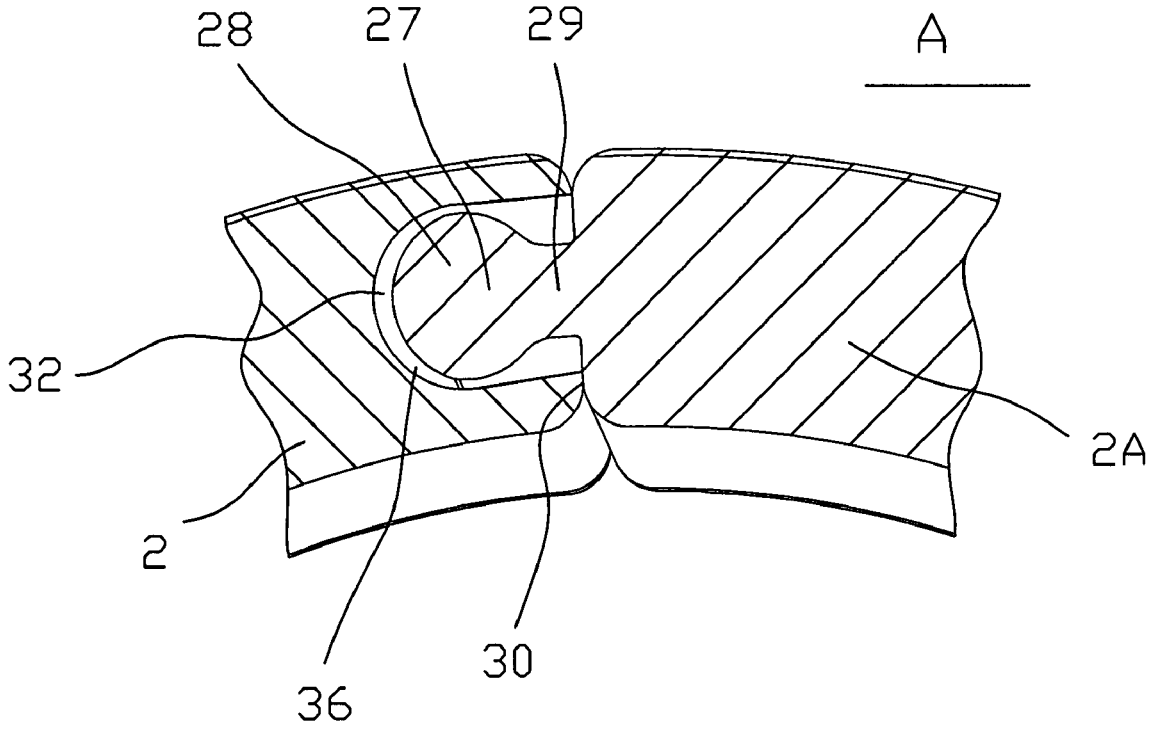
FIG. 20A is an enlarged sectional side view A from FIG. 20.

For all embodiments the outer junction means 7 can be made as a ledge 27 protruded along a side part 30 of the elements 2 (FIGS. 7, 7A and 12), and the ledge 27 made as a part of a torus ring 29 integrated by a shorter part of a narrow cylindrical ring with the side part 30 (FIGS. 18A and 20A). Correspondingly, the inner junction means 8 can be made as a groove 31 spaced along a side part 30 of the elements 2, and the groove 31 has the bigger similar cross-section like the ledge 27, thus the ledge 27 at least partially surrounded by the groove 31 (FIGS. 7, 7A, 12, 18 and 18A).

Figure 19:
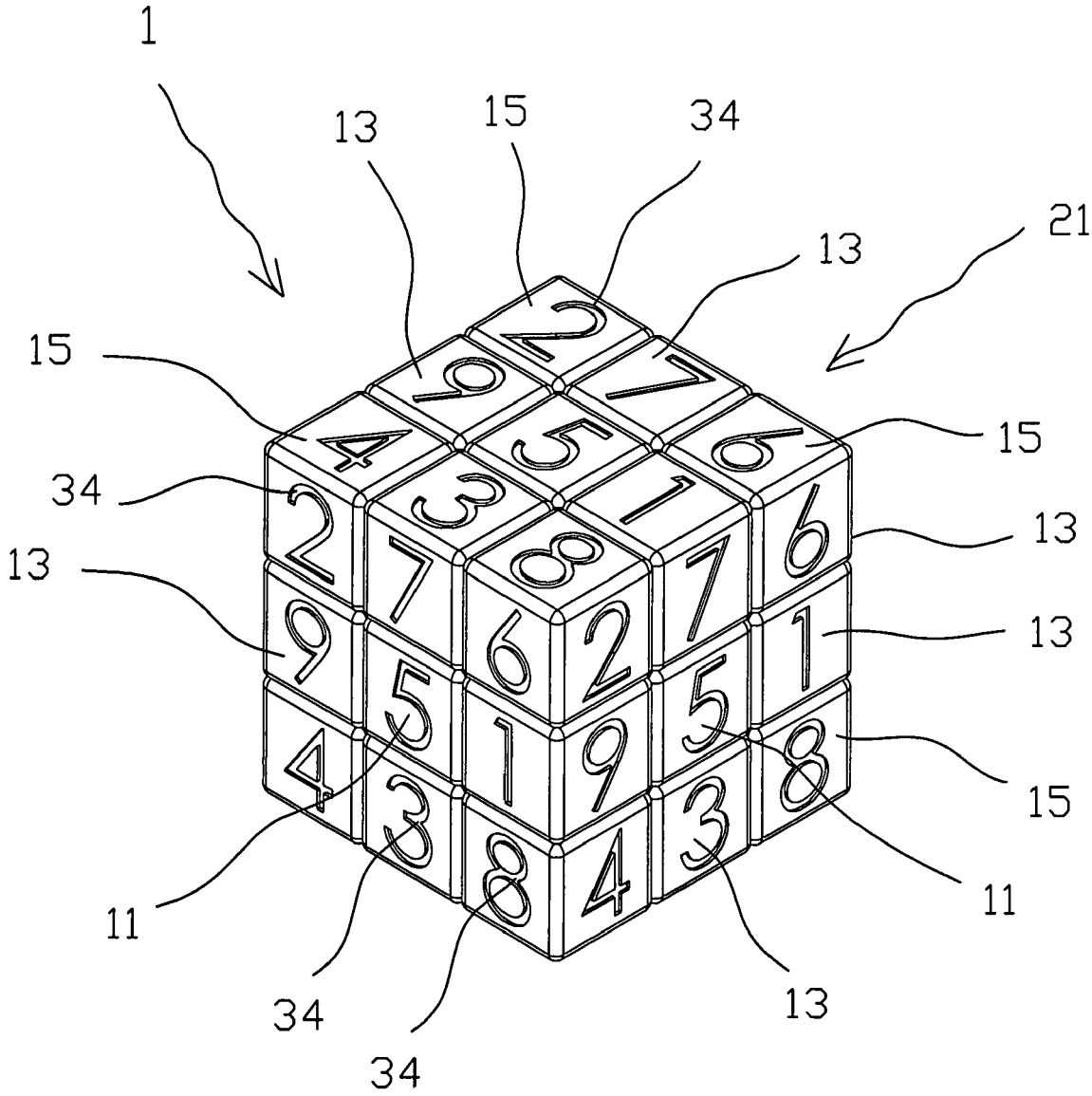
FIG. 19 is a perspective view showing the preferred embodiment of the present invention where coordination means are numbers form a magic quadrate on each differently colored side of the cube. The coordination means made as colored surfaces are not shown.

The coordination means 17 (FIGS. 8, 10, 11, 14, 16, 17, 21-23) can be made as colored surfaces 33 with letters and/or numbers 34. The coordination means 17 can be also made as numbers 34 that form a magic quadrate on each differently colored side of the cube 21, if the three-dimensional shaped body 3 made as a cube 21 (FIG. 19). The numbers 34 put in order of the magic quadrate characterized that for each colored side of the cube 21 the sums of the numbers 34 in horizontal, vertical and diagonal directions are equal to 15.

The key open means 35 of the ledge 27 can be made by reducing of length of the corresponding ledge 27 for 30%, while the key open means 36 of the corresponding groove 31 are made by deleting of the narrow part 29 of the groove 31 along corresponding length of the key open means 35 of the ledge (FIGS. 12-14, 17, 20-25).

The three-dimensional puzzle 1 may further comprise prize means 37 located with a clearance inside of the hollow sphere 4. The prize means 37 can be a similar three-dimensional puzzle 38. On FIG. 21 it is shown that inside of the three-dimensional puzzle 1 made as a cube 21 there is the three-dimensional puzzle 1 of a smaller size made as a ball 22.

Figure 24:
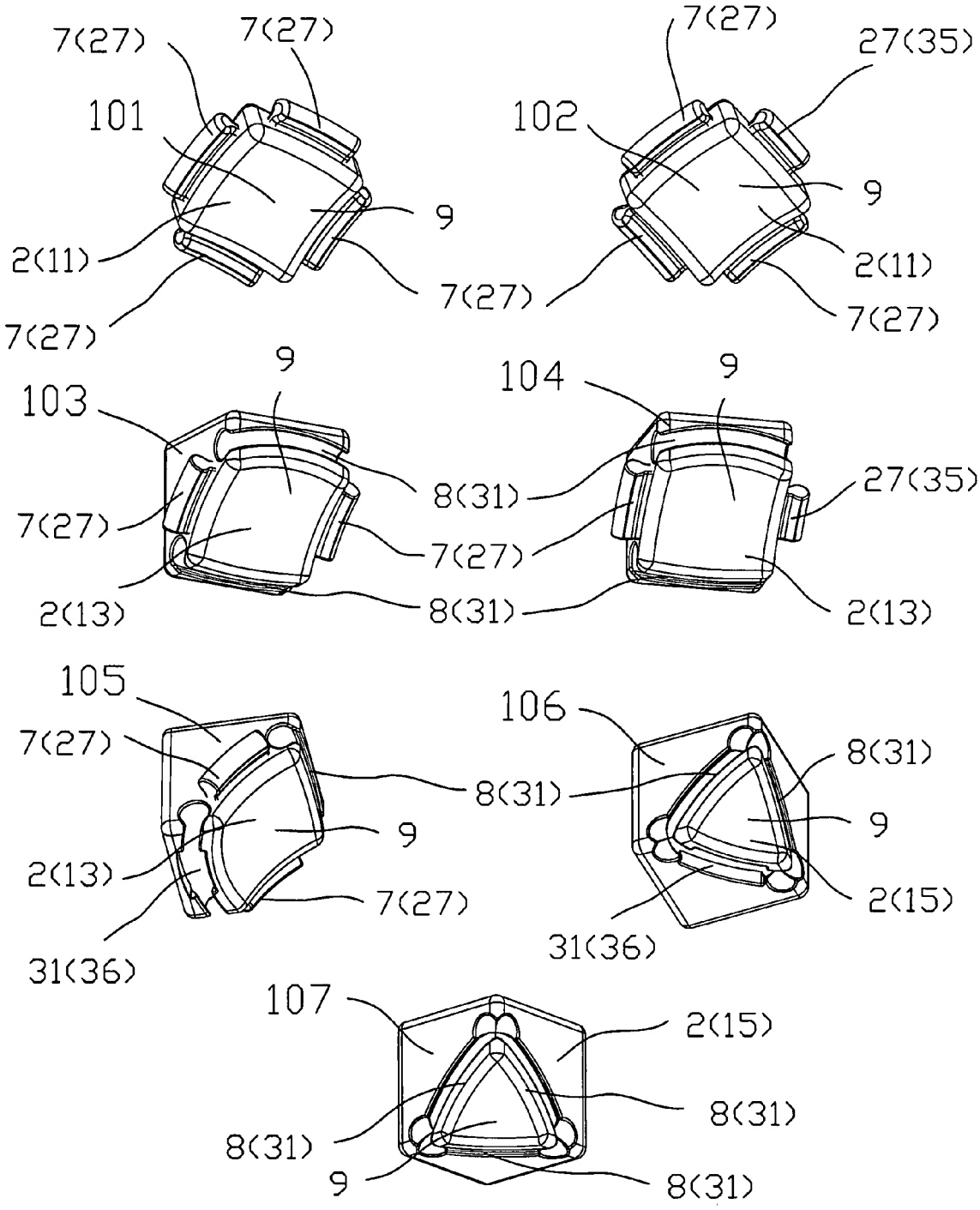
FIG. 24 is a perspective view showing all kind of elements from FIG. 22.

On FIG. 24 all elements 2, needed to assemble the three-dimensional puzzle 1 according to the preferred embodiment of the present invention, made as a cube 21. The full set of elements 2 comprises two elements 11 (101) without key open means, four elements 11 (102) with one key open means 35, four elements 13 (103) without key open means, four elements 13 (104) with one key open means 35, four elements 13 (105) with one key open means 36, four elements 15 (106) with one key open means 36 and four elements 15 (107) without key open means.

Figure 25:
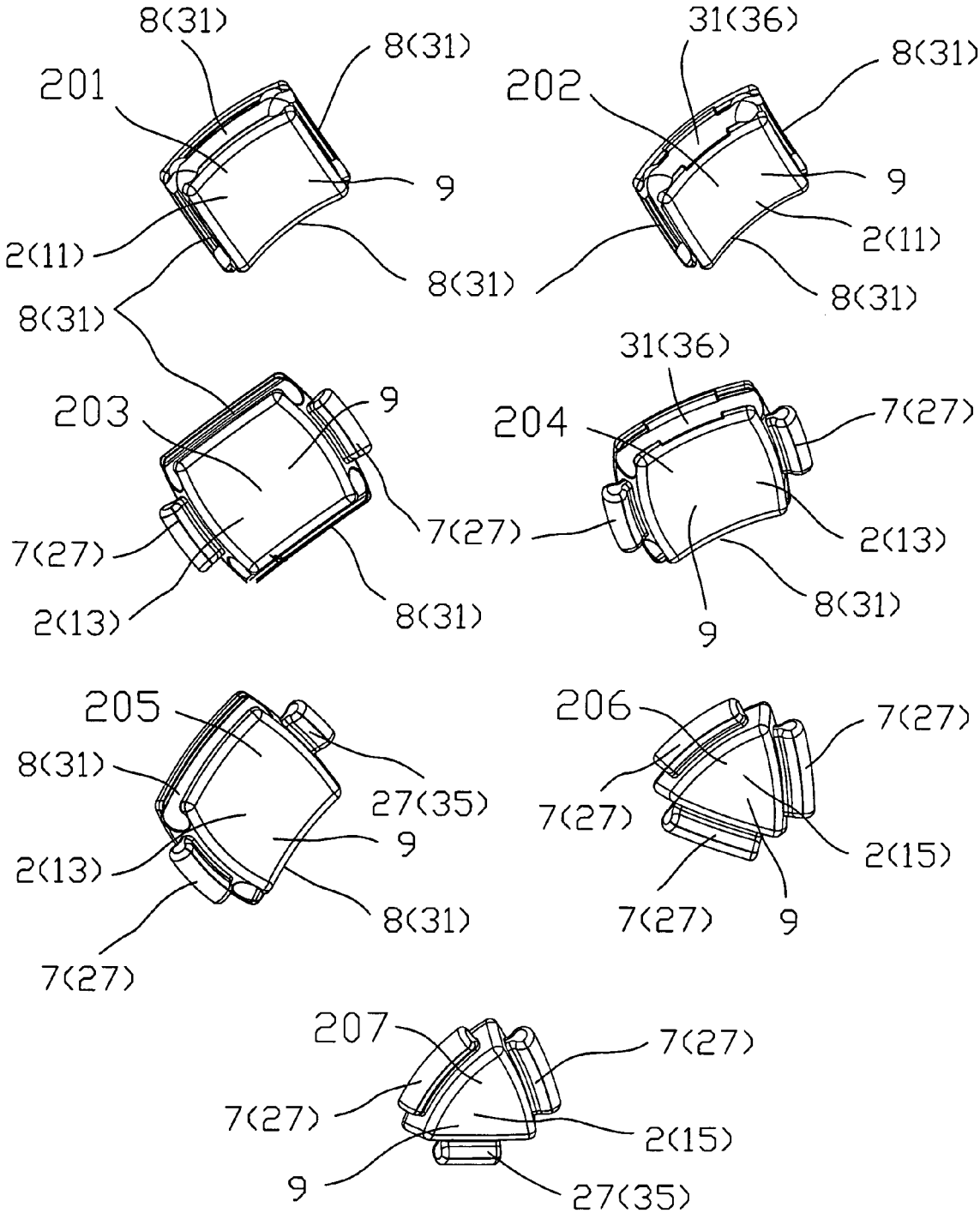
FIG. 25 is a perspective view showing all kind of elements from FIG. 23.

And, on FIG. 25 all elements 2, needed to assemble the three-dimensional puzzle 1 according to the second embodiment of the present invention, made as a ball 22. The full set of elements 2 comprises two elements 11 (201) without key open means, four elements 11 (202) with one key open means 36, four elements 13 (203) without key open means, four elements 13 (204) with one key open means 36, four elements 13 (205) with one key open means 35, four elements 15 (206) without key open means and four elements 15 (207) with key open means 35.

All elements 11, 13 and 15 shown at FIG. 24 have the same inner surfaces 9 belong to the hollow sphere, like elements 11, 13 and 15 correspondingly, shown at FIG. 25. The corresponding elements 11, 13 and 15 shown at FIGS. 24 and 25 are different by the outer surfaces which for all elements shown at FIG. 24 are partial surfaces of the cube, while for all elements shown at FIG. 25 are partial surfaces of the sphere.

All elements 2 for all embodiments can be made from the self-lubricated plastic material, thus provide smooth and easy rotation of all elements during assembling the three-dimensional puzzle 1. The design of the puzzle 1 does not require a big clearance between elements 2 and between key open means 35 and 36 correspondingly. For example, the clearance between the elements 2 defined by the thickness of the conical surfaces 6 tends to a zero value preferably, thus prevent the loss of the shape stability of the group of elements 2 and not embarrassed the rotation in respect to other elements 2.

Figure 22:
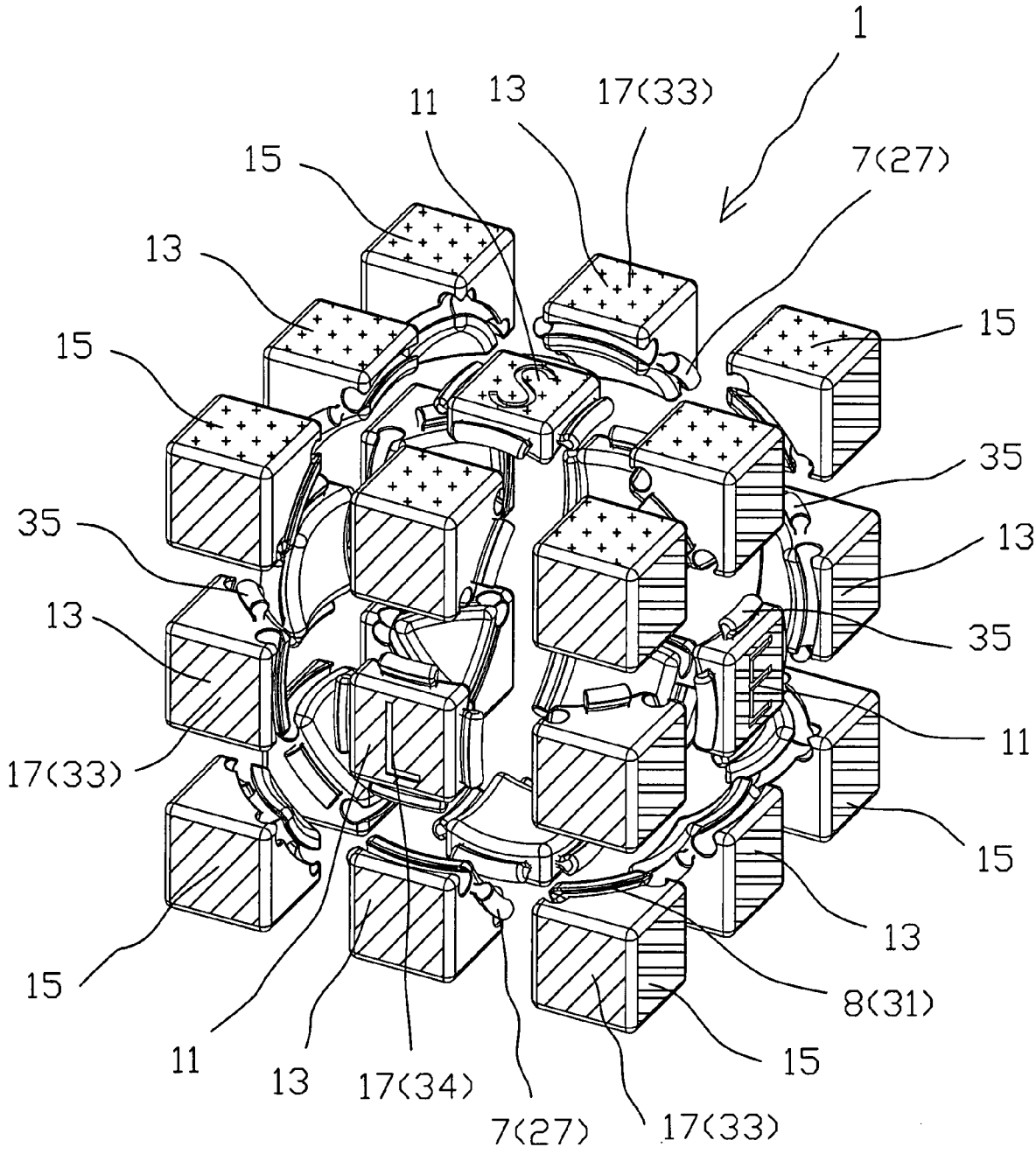
FIG. 22 is a perspective exploded view showing the disassembled condition of the preferred embodiment of the present invention where all element are spaced apart from each other.
Figure 23:
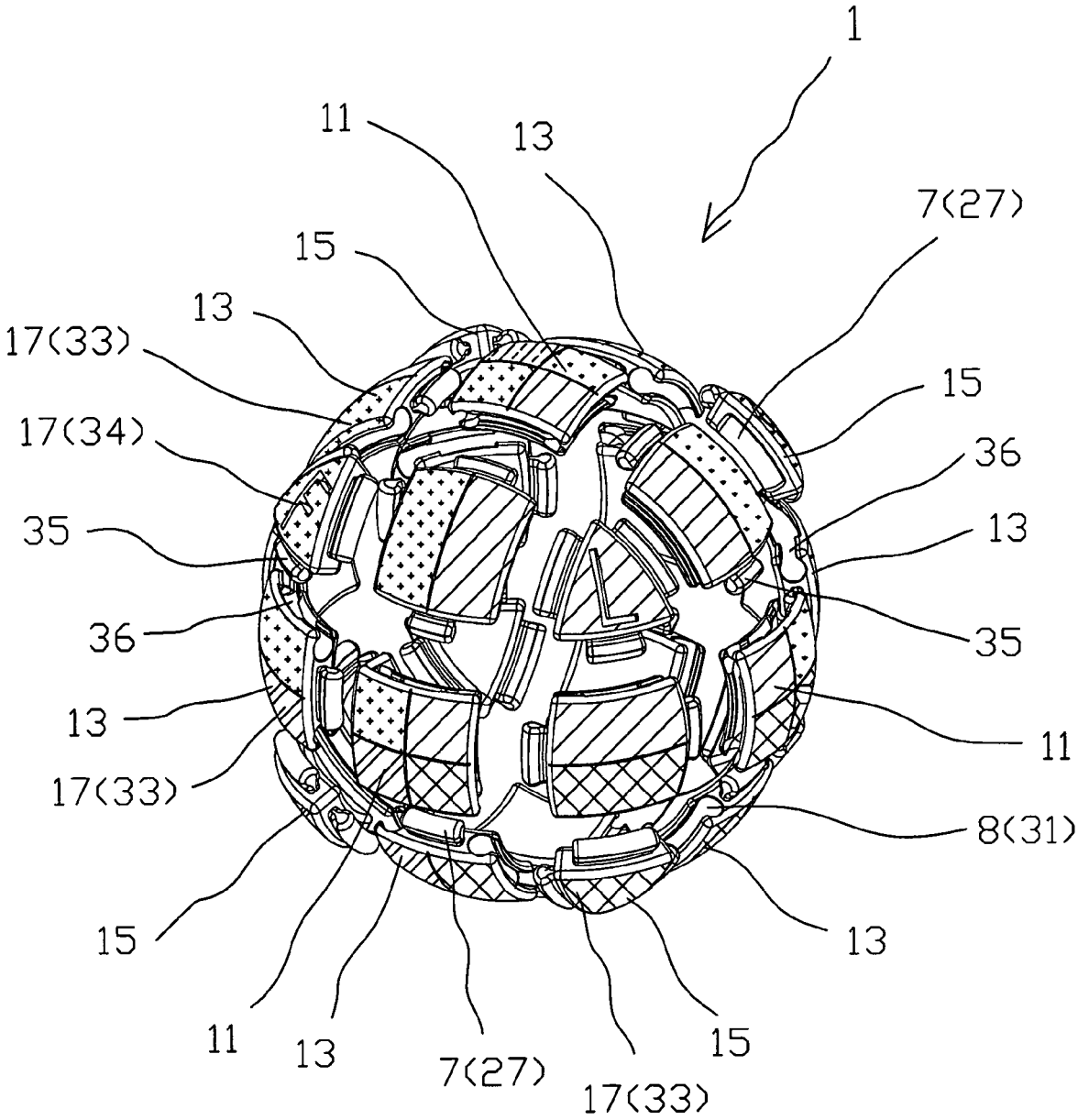
FIG. 23 is a perspective exploded view showing the disassembled condition of the second embodiment of the present invention where all element are spaced apart from each other.

The preferred embodiment of the present invention, where the 3D shaped body is a cube, can be assembled from the disassembled condition shown on FIG. 22 to the assembled condition with the initial ordered orientation shown on FIG. 17, in the following way.

For the simplification for all elements 101-107 needed for assembly and shown on FIG. 24, the coordination means made as colored surfaces are not shown, but it is understood that each element 101-107 that will place in assembly corresponds to their own position and orientation in respect to the initial ordered three-dimension puzzle 1.

Figure 26:
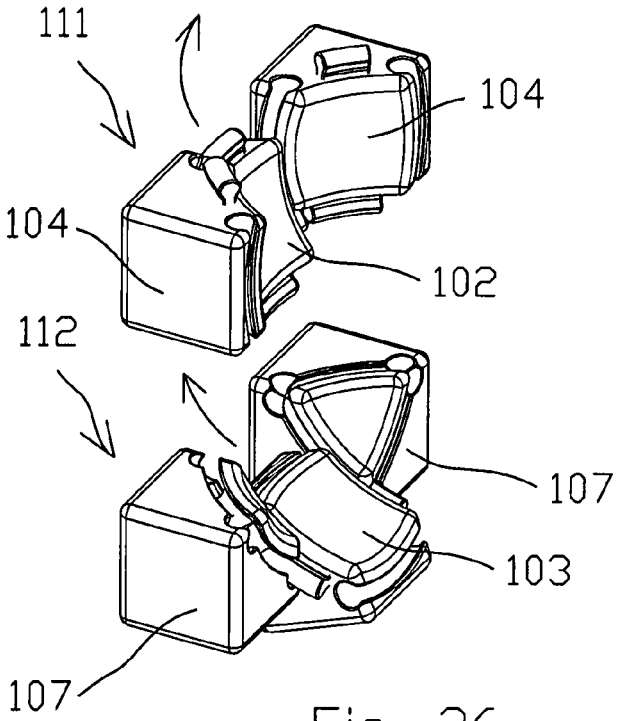
FIGS. 26-29 are perspective views showing step-by-step assembling of the preferred embodiment of the present invention from the disassembled condition shown on FIG. 22 to the assembled initial ordered condition shown on FIG. 17.
Figure 26A:
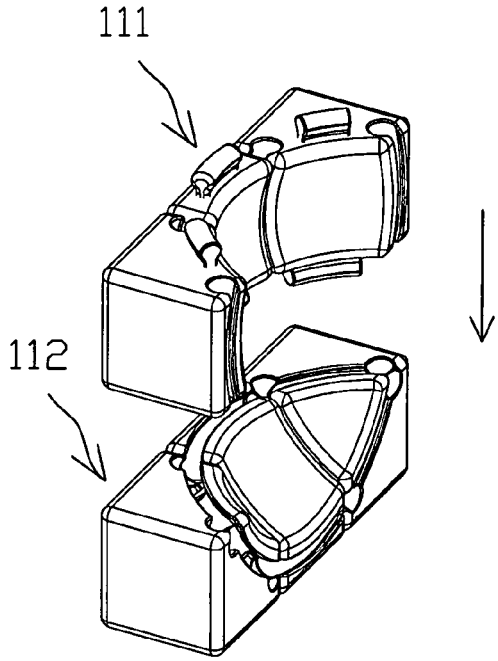

At the first step (FIG. 26), the element 102 placed between two elements 104, thus the corresponding ledges 27 of the element 102 partially inserted into the corresponding grooves 31 of the elements 104. After the corresponding rotation of the element 102 around the axis OX, the element 102 and two elements 104 form the group of elements 111 (FIG. 26A). At the same time, by the analogous way, the element 103 and two elements 107 form the group of elements 112 as well (FIG. 26A).

Figure 26B:
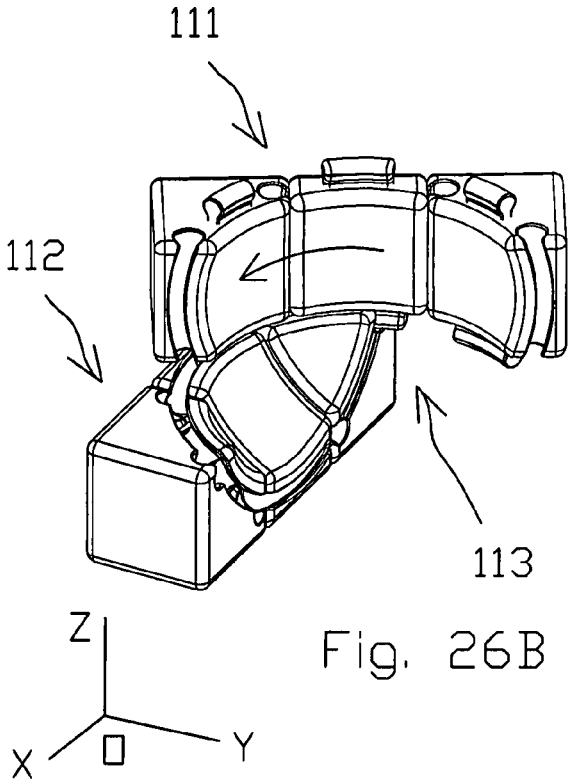
Figure 26C:
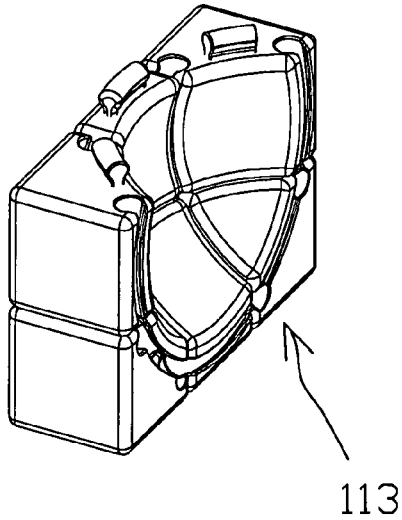

At the second step the group of elements 111 attached to the group of elements 112 (FIG. 26B), thus the corresponding ledges 27 of the group of elements 111 partially inserted into the corresponding grooves 31 of the group of elements 112. After the corresponding rotation of the group of elements 111 around the axis OZ, the group of elements 111 and the group of elements 112 form the group of elements 113 (FIG. 26C).

Figure 27:
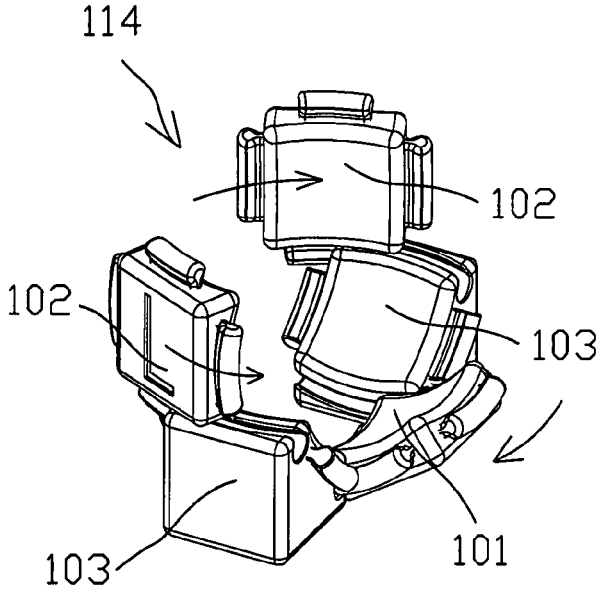
Figure 27A:
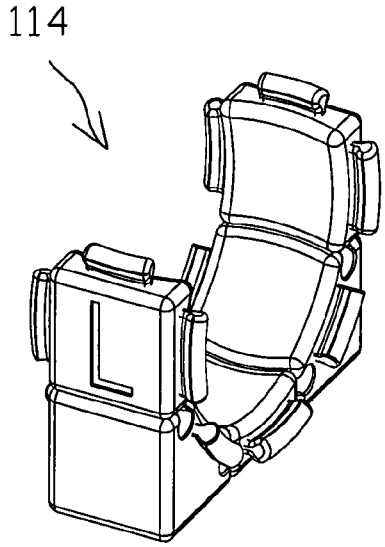

At the third step (FIG. 27), the element 101 placed between two elements 103, thus the corresponding ledges 27 of the element 101 partially inserted into the corresponding grooves 31 of the elements 103, while two elements 102 attached to the corresponding elements 103, thus the corresponding ledges 27 of the elements 102 partially inserted into the corresponding grooves 31 of the elements 103. After the corresponding rotation of the element 101 around the axis OX and the elements 102 around the axis OZ, the element 101, two elements 102 and two elements 103 form the group of elements 114 (FIG. 27A).

Figure 27B:
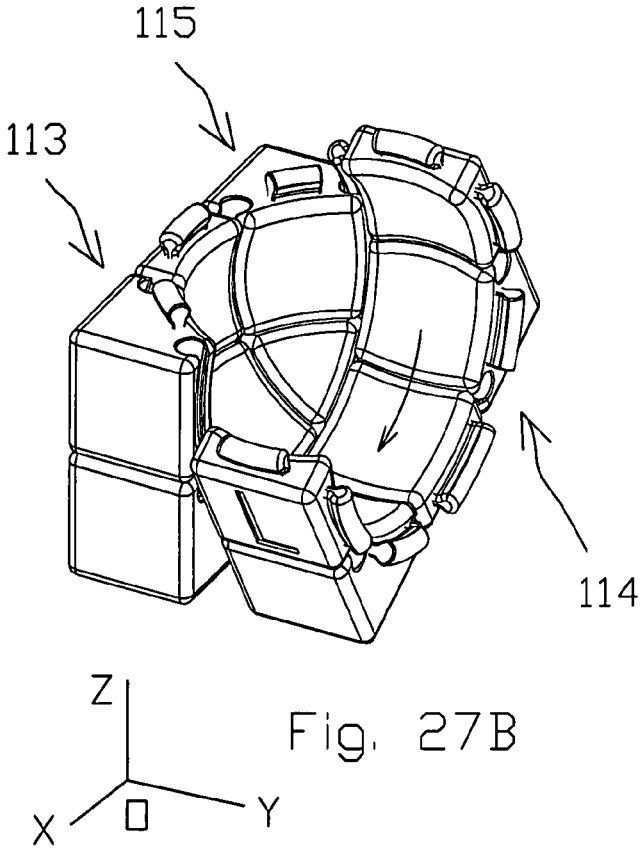
Figure 27C:
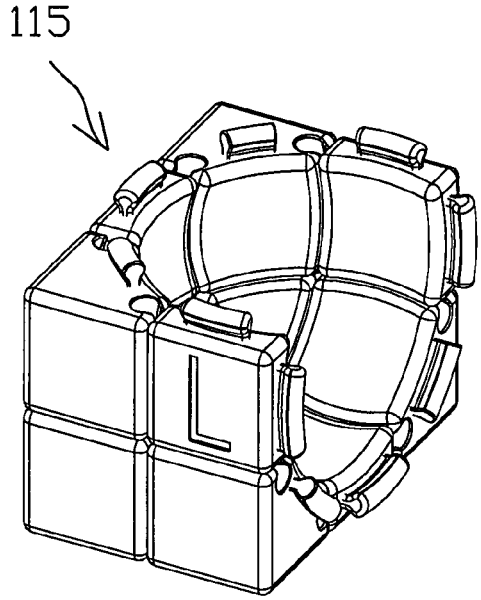

At the next step the group of elements 114 attached to the group of elements 113 (FIG. 27B), thus the corresponding ledges 27 of the group of elements 114 partially inserted into the corresponding grooves 31 of the group of elements 113. After the corresponding rotation of the group of elements 114 around the axis OY, the group of elements 113 and the group of elements 114 form the group of elements 115 (FIG. 27C).

Figure 28:
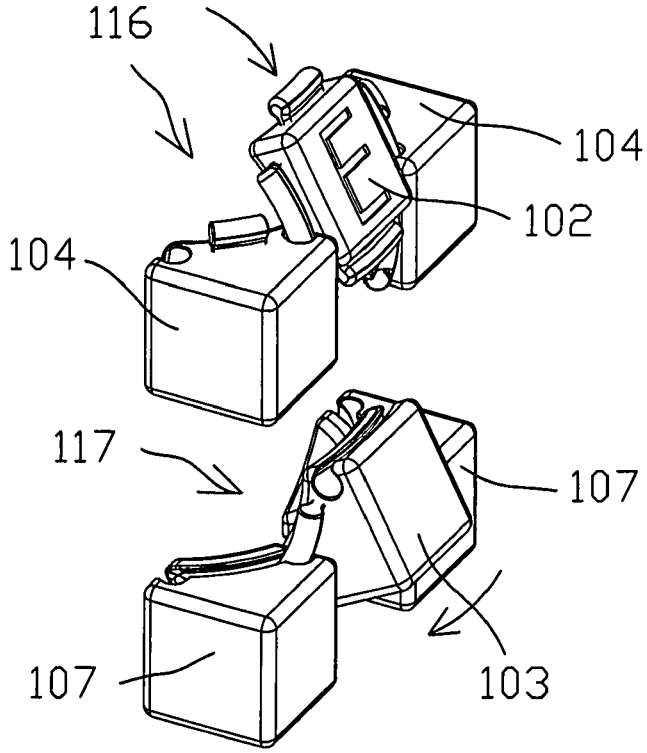

At the fifth step (FIG. 28), the element 102 placed between two elements 104, thus the corresponding ledges 27 of the element 102 partially inserted into the corresponding grooves 31 of the elements 104. After the corresponding rotation of the element 102 around the axis OX, the element 102 and two elements 104 form the group of elements 116 (FIG. 28). At the same time, by the analogous way, the element 103 and two elements 107 form the group of elements 117 as well (FIG. 28).

Figure 28A:
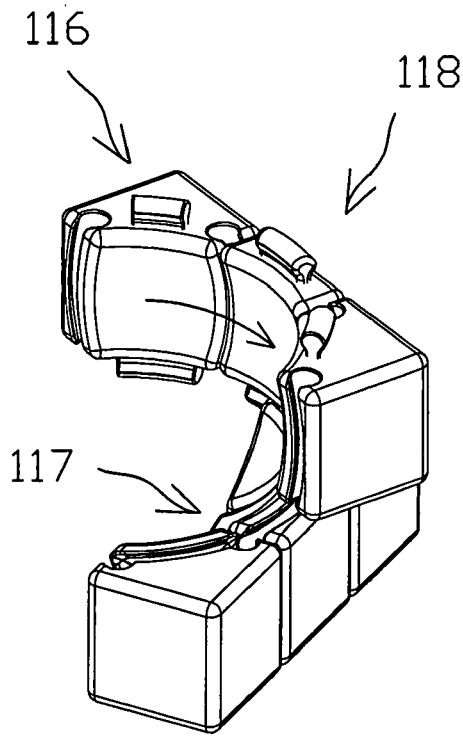

At the six step the group of elements 116 attached to the group of elements 117 (FIG. 28A), thus the corresponding ledges 27 of the group of elements 116 partially inserted into the corresponding grooves 31 of the group of elements 117. After the corresponding rotation of the group of elements 116 around the axis OZ, the group of elements 116 and the group of elements 117 form the group of elements 118 (FIG. 28A).

Figure 28B:
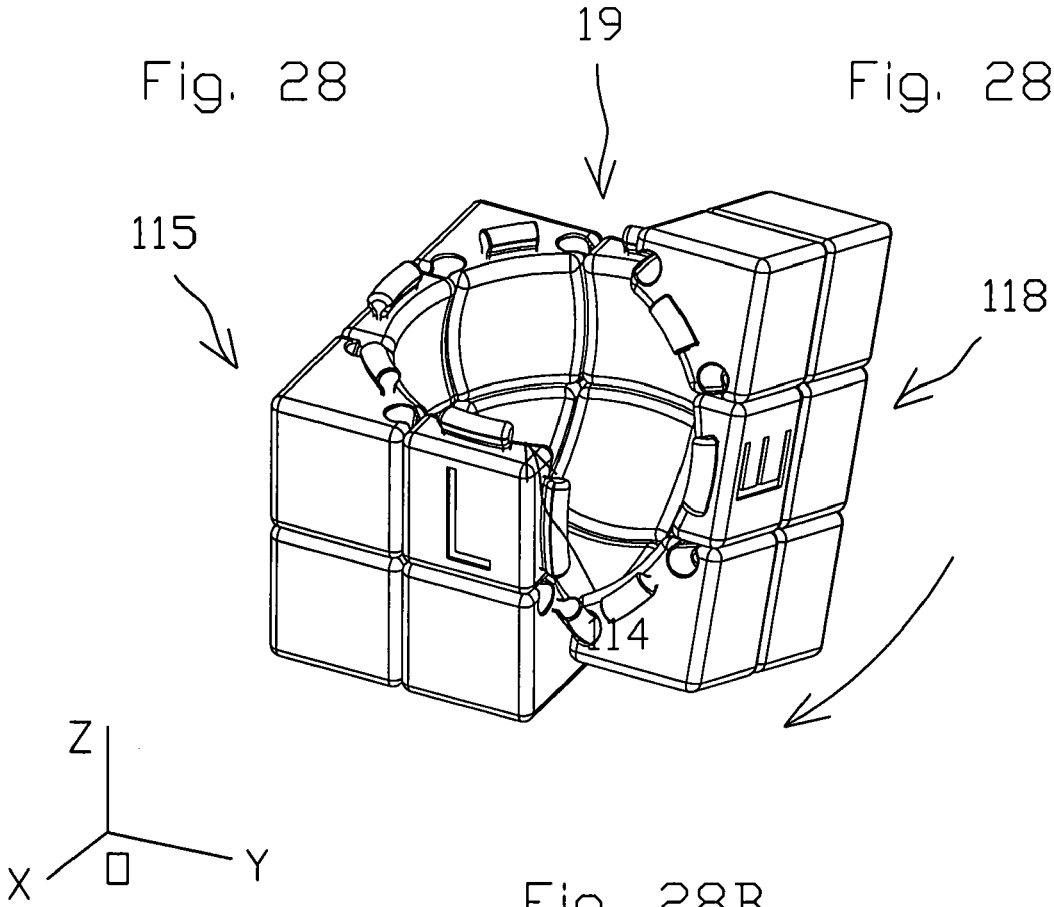

At the next step the group of elements 118 attached to the group of elements 115 (FIG. 28B), thus the corresponding ledges 27 of the group of elements 115 partially inserted into the corresponding grooves 31 of the group of elements 118. After the corresponding rotation of the group of elements 118 around the axis OY, the group of elements 115 and the group of elements 118 form the part of elements 19 (FIGS. 17, 21 and 28B).

Figure 29:
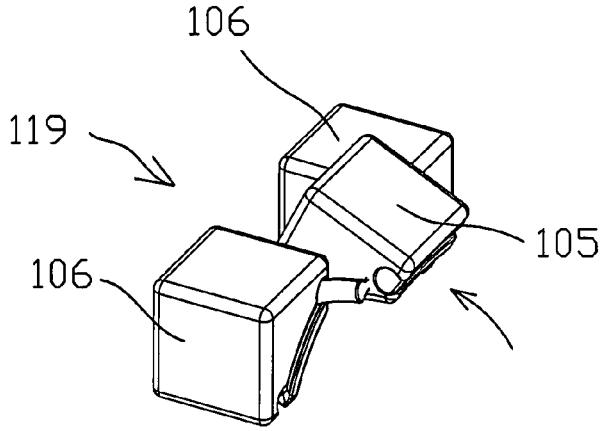
Figure 29A:
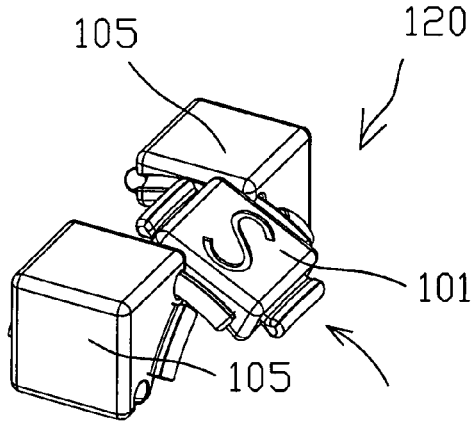

At the eighths step (FIGS. 29 and 29A), the element 105 placed between two elements 106, thus the corresponding ledges 27 of the element 105 partially inserted into the corresponding grooves 31 of the elements 106. After the corresponding rotation of the element 105 around the axis OX, the element 105 and two elements 106 form the group of elements 119 (FIG. 29). At the same time, by the analogous way, the element 101 and two elements 105 form the group of elements 120 as well (FIG. 29A).

Figure 29B:
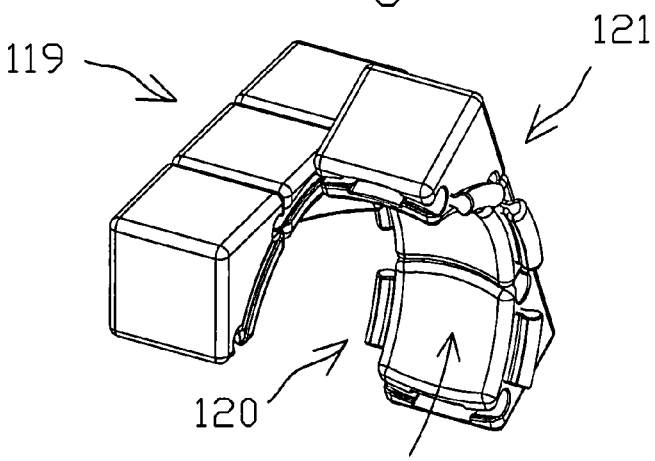

At the ninth step the group of elements 120 attached to the group of elements 119 (FIG. 29B), thus the corresponding ledges 27 of the group of elements 120 partially inserted into the corresponding grooves 31 of the group of elements 119. After the corresponding rotation of the group of elements 120 around the axis OY, the group of elements 119 and the group of elements 120 form the group of elements 121 (FIG. 29B).

Figure 29C:
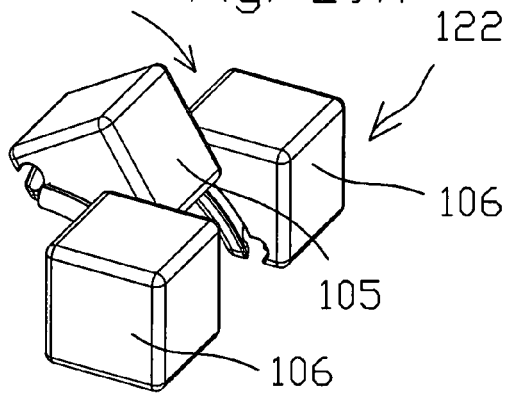

At the next step (FIG. 29C), the element 105 placed between two elements 106, thus the corresponding ledges 27 of the element 105 partially inserted into the corresponding grooves 31 of the elements 106. After the corresponding rotation of the element 105 around the axis OX, the element 105 and two elements 106 form the group of elements 122 (FIG. 29C).

Figure 29D:
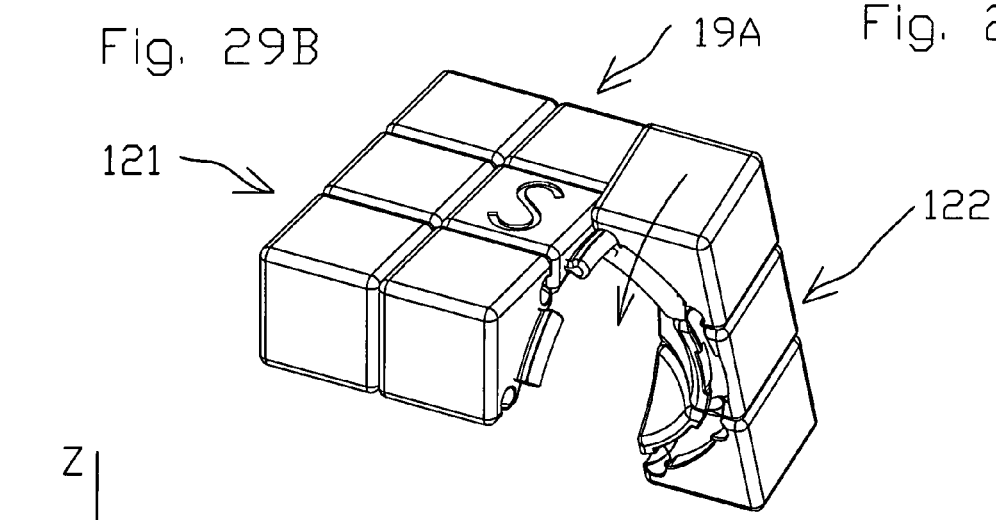
Figure 29D:
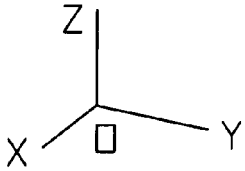

And at the last step (FIG. 29D), the group of elements 122 attached to the group of elements 121, thus the corresponding ledges 27 of the group of elements 121 partially inserted into the corresponding grooves 31 of the group of elements 122. After the corresponding rotation of the group of elements 122 around the axis OY, the group of elements 121 and the group of elements 122 form the part of elements 19A (FIGS. 17, 21 and 29D). After the attaching the part of elements 19A to the part of elements 19, thus the key open means 35 of ledge 27 of the corresponding elements of the group of elements 19 inserted into the key open means 36 of grooves 31 of the corresponding elements of the group of elements 19A, and the three-dimensional puzzle 1 became assembled to the initial ordered orientation.

It is understood that all other embodiments with the different 3D shaped body can be assembled in the same manner.

Figure 30:
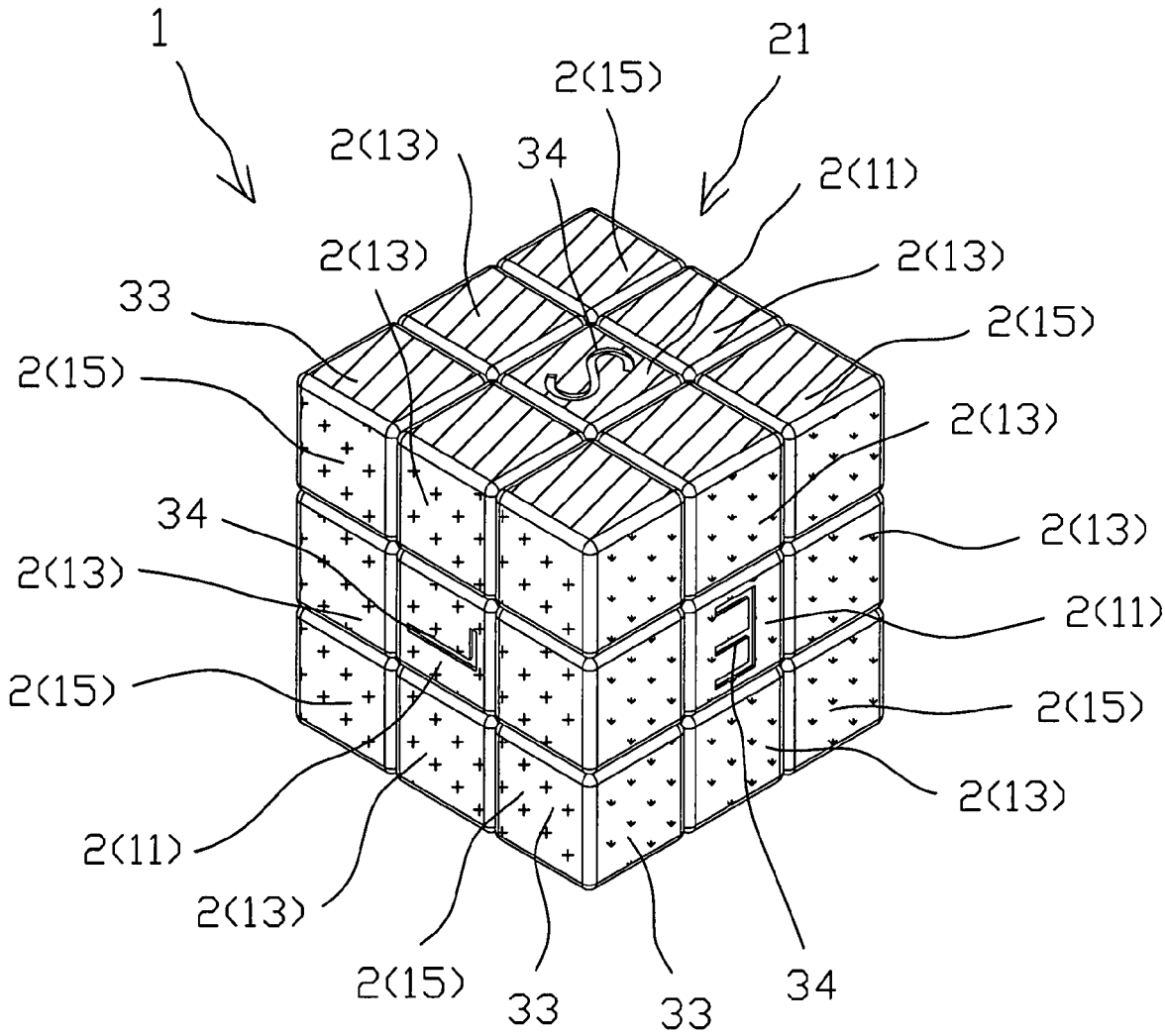
FIG. 30 is a perspective view showing the preferred embodiment of the present invention where all elements arranged to the initial ordered position, but the orientation of the polar elements does not corresponds to the initial ordered orientation.

The three-dimensional puzzle 1 according to the present invention can be open by the separation for two spaced apart parts 19 and 19A if the position and orientation of all elements 2 are correspond to the initial ordered orientation. Each of the polar elements 11 placed to the initial ordered position may be oriented by four different ways, but only one of them corresponds to the initial ordered orientation of the element 11, thus provide the ability to open the three-dimensional puzzle 1 (FIG. 17). For example, the positions of all elements 2 correspond to the initial ordered position, while the orientation of all elements 2, except the polar elements 11, also corresponds to the initial ordered orientation (FIG. 30), thus the orientation of the polar elements 11 does not corresponds to initial ordered orientation. In that case, the three-dimensional puzzle 1 can not be opened and need further arrangement. But at the same time, such arrangement of the three-dimensional puzzle 1 corresponds to the final goal of the known puzzle like Rubik's Cube. Therefore the three-dimensional puzzle 1 according to the present invention has increased difficulty level, thus provides more attraction of the puzzle.

The design of the three-dimensional puzzle according to the present invention is simple, comprises the elements 2 only which can be easily and at low cost manufactured from the low cost waxy self-lubricated plastic material, for example from polypropylene.

The samples of the three-dimensional puzzle with different 3D shaped bodies like a sphere and a cube according to the present invention, were manufactured and tested, thus successfully prove the reliable achievement of the goal.

Therefore the three-dimensional puzzle according to the present invention provides a more attractive, compact, simple, reliable and less expensive design of the puzzle.

While the invention has been described with reference to various embodiments, it will be understood that these embodiments are only illustrative that the scope of invention is not limited to them. Many variations, modifications and improvements of the embodiments described are possible. Variations and modifications of the embodiments disclosed herein may be made based on description set forth herein, without departing from the scope and spirit of the invention as set forth in the following claims.

What is claimed is:

1. A nesting puzzle comprising:

a compartment for holding at least one object or substance;

a plurality of first, second, and third tiles for enclosing the compartment, each tile having inner and outer faces and a plurality of sides, each side including a junction, the first tiles including only inner junctions, the second tiles including only outer junctions, and the third tiles including inner and outer junctions;

a plurality of rows individually rotatable in perpendicular directions to each other, each tile is included in two perpendicular rows; and a plurality of said junctions on a first plurality of said tiles collectively forming a key, the first plurality of said tiles forming said key having modified outer junction lengths and inner junctions distinct from the outer junction lengths and inner junctions of the remainder of the junctions in the puzzle, wherein when the junctions forming said key are all properly aligned by rotation into positions along two adjacent parallel rows, the junctions forming the key operate to attach or detach the tiles of the two adjacent parallel rows of the plurality of rows thereby splitting the puzzle into two sections to provide access to the compartment.

2. The puzzle of claim 1, wherein each of the outer faces includes a shape that is varied to form a plurality of puzzle shapes.

3. The puzzle of claim 1, wherein the number of the plurality of rows is increased and decreased by adding or removing one or more pairs one or more pairs parallel rows, each pair including the first, second, and third tiles.

4. The puzzle of claim 1, wherein at least one outer face of the plurality of tiles includes a marker selected from one or more colors, one or more pictures, one or more letters, and one or more numbers.

5. The puzzle of claim 1, wherein each of the inner faces includes a shape that is varied to form a plurality of compartment shapes.

6. The puzzle of claim 1, wherein the compartment is a sphere having a radius longer than a length of any side of any tile of the plurality of tiles.

7. The puzzle of claim 1, wherein the outer junction is a ledge having a length and an Ω shaped cross section protruded along the side of the tile with a part of the cross section having an opening being connected to the tile, and the inner junction is a groove having an opening width and a C shaped cross section spaced along the side of the tile with a part of the cross section opposite an opening being connected to the tile.

8. The puzzle of claim 7, wherein the junctions forming the key include ledges with reduced length and corresponding grooves with widened opening.

9. The puzzle of claim 1, wherein all the tiles within each tile chain can be brought back to their original position vis-à-vis their adjacent tiles by a series of 90 degree perpendicular rotations.

10. The puzzle of claim 1, wherein the rows include at least one center row and a plurality of peripheral rows individually rotatable in a first direction, the sides include first sides aligned along the first direction and second sides aligned along a second direction, when the second sides of the center and peripheral rows are lined-up the tiles form a plurality of columns individually rotatable perpendicular to the first direction, and the key enables the respective junctions on the sides of the tiles in adjacent parallel center and one or more peripheral rows to detach.

11. The puzzle of claim 1, wherein the length of the outer junctions forming the key is reduced by about 30%.

12. A puzzle comprising:

a compartment for holding one or more objects;

first and second sections for substantially enclosing the compartment, the first and second sections comprising a plurality of first, second, and third tiles forming rows by attaching to preceding and following tiles, the tiles being individually rotatable in first and second perpendicular directions, all tiles having inner and outer faces and a plurality of sides, the first and second tiles including opposite single sex junctions, and the third tiles including male and female junctions for connecting to opposite sex junction of the adjacent tiles, the male junction is a ledge having an Ω shaped cross section and a length and protruding along a side of the tile, the female junction is a groove having a C shaped cross section and an opening width spaced along the side of the tile;

a plurality of said junctions on a first plurality of said tiles collectively forming a key, the first plurality of said junctions forming said key having modified ledge lengths and grooves distinct from the ledge lengths and grooves of the remainder of the junctions in the puzzle, wherein when the junctions forming said key are all properly aligned by rotation into positions along adjacent tiles of the first and second sections, the junctions forming the key operate to attach or detach the tiles of the adjacent tiles of the first and second sections of the plurality of rows thereby splitting the puzzle into two sections to provide access to the compartment.

13. The puzzle of claim 12, wherein each of the outer and inner faces of the plurality of tiles comprises one or more shapes.

14. The puzzle of claim 13, wherein the shapes of the outer and inner faces of the plurality of tiles are varied to form a puzzle shape and a compartment shape, and at least one outer face includes a marker selected from one of one or more colors, one or more pictures, one or more letters, and one or more numbers.

15. The puzzle of claim 12, wherein the number of the plurality of rows in the first and second sections is increased and decreased by adding or removing one or more pairs of parallel rows, each pair including the first, second, and third tiles.

16. The puzzle of claim 14, wherein the puzzle shape and the compartment shape are selected from one of a sphere and a cube.

* * * * *